US010796526B2

(12) United States Patent
Arnone et al.

(10) Patent No.: US 10,796,526 B2
(45) **Date of Patent: *Oct. 6, 2020**

(54) GAMBLING COMMUNICATOR SYSTEM

(71) Applicant: Gamblit Gaming, LLC, Glendale, CA (US)

(72) Inventors: Miles Arnone, Sherborn, MA (US); Eric Meyerhofer, Pasadena, CA (US); Caitlyn Ross, Watertown, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/384,817

(22) Filed: Apr. 15, 2019

(65) Prior Publication Data

US 2019/0236895 A1 Aug. 1, 2019

Related U.S. Application Data

(63) Continuation of application No. 15/862,329, filed on Jan. 4, 2018, now Pat. No. 10,262,492, which is a continuation of application No. 14/708,160, filed on May 8, 2015, now abandoned, which is a continuation of application No. PCT/US2013/069011, filed on Nov. 7, 2013.

(60) Provisional application No. 61/724,112, filed on Nov. 8, 2012.

(51) Int. Cl.
*G07F 17/32* (2006.01)

(52) U.S. Cl.
CPC ..... *G07F 17/3225* (2013.01); *G07F 17/3223* (2013.01); *G07F 17/3244* (2013.01)

(58) Field of Classification Search
CPC ..... G07F 17/3258; G07F 17/3225; G07F 17/3272
See application file for complete search history.

(56) References Cited

U.S. PATENT DOCUMENTS 6,050,895 A * 4/2000 Luciano, Jr. ..... G07F 17/32 463/20
2004/0225387 A1* 11/2004 Smith, III ..... G07F 17/32 700/92
2005/0192087 A1* 9/2005 Friedman ..... G07F 17/32 463/25
2013/0053118 A1* 2/2013 Schueller ..... G07F 17/3218 463/17

* cited by examiner

*Primary Examiner* — David L Lewis
*Assistant Examiner* — Shauna-Kay Hall
(74) *Attorney, Agent, or Firm* — Frank Cire

(57) ABSTRACT

Systems and methods for providing a gambling game communicator in an interface of a gambling communicator hybrid game are disclosed. The gambling game communicator conveys information about the occurrences and outcomes of gambling events and any wagers on the results of the gambling events.

9 Claims, 27 Drawing Sheets

GAMBLING COMMUNICATOR SYSTEM

CROSS-REFERENCE TO RELATED APPLICATIONS

This application is a continuation U.S. patent application Ser. No. 15/862,329 filed Apr. 1, 2018, which is a continuation U.S. patent application Ser. No. 14/708,160 filed May 8, 2015, which is a continuation of Patent Cooperation Treaty Application No. PCT/US13/69011, filed Nov. 7, 2013 which claims the benefit of U.S. Provisional Application No. 61/724,112, filed Nov. 8, 2012, the disclosures of each of which are incorporated herein by reference as if set forth herewith.

FIELD OF THE INVENTION

Embodiments of the present invention are generally related to gaming and more specifically to systems and processes that provide gambling results to a user for a gambling communicator hybrid game.

BACKGROUND OF THE INVENTION

The gaming machine manufacturing industry provides a variety of gaming machines to enable wagering for interested parties whilst providing an entertainment experience. An exemplary gaming machine is a slot machine. As the demographic of eligible players has shifted with time to newer generations who have grown accustomed to highly sophisticated graphics and interactive video games, a need has arisen to increase the entertainment content present on a gaming machine to keep it relevant, at least to a growing portion of a casino's patronage. The subject design is a form of gaming machine, designed for use in a physical or virtual casino environment, which provides players an environment in which to play for cash, prizes and points, either against the casino or in head to head modes in a controlled and regulated manner while being allowed to use their skills and adeptness at a particular type of game. An example of such a game would be a challenging word spelling game, or an interactive action game such as is found on video game consoles popular today, such as a PlayStation®, an Xbox®, a Wii® or a PC based.

SUMMARY OF THE INVENTION

In many embodiments, a server is constructed to execute a wager in accordance with a gambling proposition and contain the auditable systems and functions enabling gaming regulatory body approval. However, the wager is to be initiated by, and the result of the wager is to be communicated to, a computing device in an environment that is separate from server and its auditable systems and functions enabling gaming regulatory body approval. A controller is used to interface between the server and its auditable systems and the computing device in its separate environment.

Embodiments of the invention provide an electromechanical gaming machine. In an embodiment, a electromechanical gaming machine comprises: an entertainment system engine including a user input device and a display output device and connected to a game world engine, wherein the entertainment system engine is constructed to: provide a user interface for a player of an interactive entertainment game of skill, wherein the user interface includes an entertainment game portion and a gambling game communicator portion; communicate to the controller via the network, an action taken by the player while playing the entertainment game and interacting with the entertainment game portion of the user interface; receive from the controller via the network, gambling game communicator information; and display the gambling game communicator information to the player using the gambling game communicator portion of the user interface. The network distributed processing system further comprises a server connected to the controller via a communication link, wherein the server is constructed to: receive from the controller via the communication link, a trigger of a gambling event of a wager of real world credits; execute a wager of real world credits in accordance with a regulated gambling proposition to determine a result of the gambling event; and communicate to the controller via the communication link, the result of the gambling event. The controller is connected to the mobile computing device by the network and connected to the server by the communication link, and is configured to: receive from the mobile computing device via the network, the player action; determine the trigger of the gambling event using the player action; communicate to the server via the communication link, the trigger of the gambling event; receive from the server via the communication link, the result of the gambling event; generate the gambling game communicator information based upon the result of the gambling event; and communicate to the mobile computing device via the network, the gambling game communicator information.

In some embodiments, the gambling game communicator portion includes a gambling game presentation portion and a status portion.

In various embodiments, the gambling game presentation portion includes a graphical depiction of a gambling game.

In some embodiments, the gambling game presentation portion includes a textual description of the gambling event.

In various embodiments, the gambling game presentation portion includes an audio presentation related to the gambling event.

In another embodiment, the status portion includes a graphic depiction indicating the result of a wager on the gambling event.

In yet another embodiment, the controller and the server are constructed from a same processing apparatus.

In various embodiments, the controller and the server are constructed from different processing apparatuses, and wherein the communication link utilizes the network.

DETAILED DISCLOSURE OF THE INVENTION

Turning now to the drawings, systems and methods for generating displays incorporating a gambling communicator for use in gambling communicator hybrid game user interfaces in accordance with some embodiments of this invention are illustrated. In gambling communicator hybrid games, a gambling communicator provides a method of communicating gambling event results in a variety of formats. The formats may be modified to fit within an entertainment game system to minimize disruption, and/or may be designed to allow players to throttle betting.

During gameplay of a gambling communicator hybrid game, a player is engaged in an entertainment game. At certain points in the game, gambling events may occur. The player may wager on the outcome of the gambling events. The wagering may be simultaneous with the game play of the entertainment game or the entertainment game may be paused to allow the gambling event to occur. A gambling communicator conveys information about the occurrences and outcomes of the gambling event and any wagers on the results of the gambling event. The various user interfaces of the gambling communicator may be selected through a Host Mode system and depending on the game in question, may be adjusted during game play. Each user interface may be individually adjustable by changing aspects of the gambling communicator including (but not limited to) the transparency, location, size and/or volume of the gambling communicator.

Gambling Communicator Hybrid Games

Figure 1:
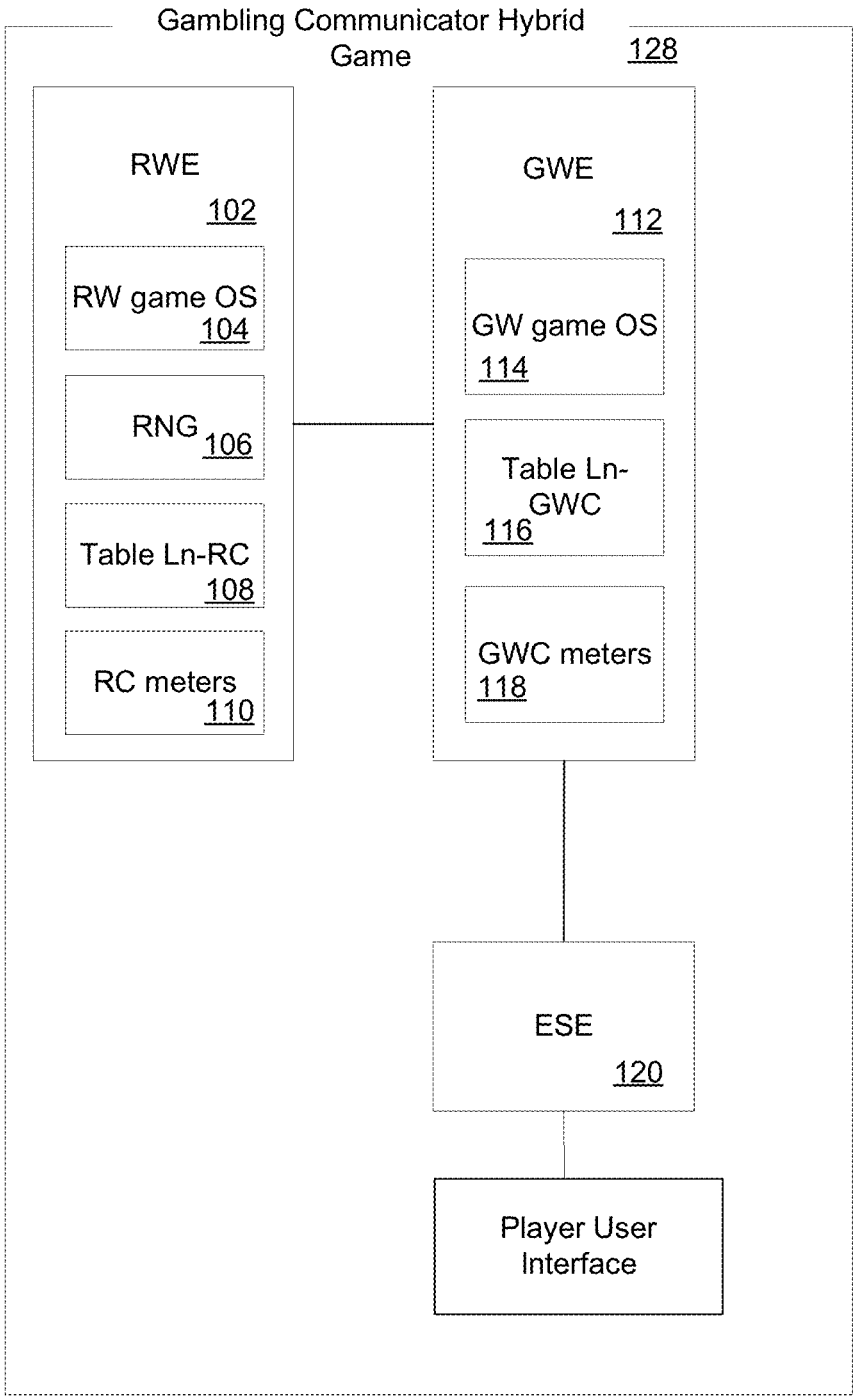
FIG. 1 illustrates a conceptual diagram of components of a gambling communicator hybrid game in accordance with an embodiment of the invention.

In accordance with many embodiments of this invention, a gambling communicator hybrid game integrates high-levels of entertainment content with a game of skill (entertainment game) and a gambling experience with a game of chance (gambling game). A gambling communicator hybrid game provides for random outcomes independent of player skill while providing that the user's gaming experience (as measured by obstacles/challenges encountered, time of play and other factors) is shaped by the player's skill. The outcome of a gambling proposition that is determined by a Random Number Generator (RNG) or other such device that provides a random outcome in response to a request. In accordance with some embodiments, the wager game may be initiated in response to a game object related player action. A gambling communicator hybrid game in accordance with an embodiment of the invention is illustrated in FIG. 1. The gambling communicator hybrid game 128 includes a Real World Engine (RWE) 102, a Game World Engine (GWE) 112, an Entertainment System Engine (ESE) 120, a gambling game user interface 122 and an entertainment game user interface 124. The two user interfaces can be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In accordance with several embodiments, the RWE 102 is the operating system for the gambling game of the gambling communicator hybrid game 128 and controls and operates the gambling game. The operation of a gambling game is enabled by Real World Currency (RC), such as money or other real world funds. A gambling game can increase or decrease an amount of RC based on random gambling outcomes, where the gambling proposition of a gambling game is typically regulated by gaming control bodies. In many embodiments, the RWE includes a Real World (RW) operating system (OS) 104, RNG 106, level n real-world credit pay tables (table Ln-RC) 108, RC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithms and/or processes, which are used to generate random outcomes. A level n real-world credit pay table (table Ln-RC) 108 is a table that can be used in conjunction with a random number generator (RNG) 106 to dictate the RC earned as a function of sponsored gameplay and is analogous to the pay tables used in a conventional slot machine. Table Ln-RC payouts are independent of player skill. There can be one table or multiple tables included in Ln-RC pay tables 108 contained in a gambling game, the selection of which can be determined by factors including (but not limited to) game progress that a player has earned, and/or bonus rounds for which a player can be eligible. RCs are credits analogous to slot machine game credits, which are entered into a gambling game by the user, either in the form of money such as hard currency or electronic funds. RCs can be decremented or augmented based on the outcome of a random number generator according to the table Ln-RC real world credits pay table 108, independent of player skill. In certain embodiments, an amount of RC can be used as criteria in order to enter higher ESE game levels. RC can be carried forward to higher game levels or paid out if a cash out is opted for by a player. The amount of RC used to enter a specific level of the game level n need not be the same for each level.

In accordance with some embodiments of this invention, the GWE 112 manages the overall gambling communicator hybrid game operation, with the RWE 102 and the ESE 120 effectively being support units to the GWE 112. In accordance with some of these embodiments, the GWE 112 contains mechanical, electronic, and software systems for an entertainment game. The GWE 112 includes an operating system (OS) 114 that provides control of the entertainment game. The GWE additionally contains a level n game world credit pay table (table Ln-GWC) 116 from where to take input from this table to affect the play of the entertainment game. The GWE 112 can further couple to the RWE 102 to determine the amount of RC available on the game and other metrics of wagering on the gambling game (and potentially affect the amount of RC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120.

In accordance with some embodiments, a level n game world credit pay table (Table Ln-GWC) 116 dictates the Game World Credit (GWC) earned as a function of player skill in the nth level of the game. The payouts governed by this table are dependent upon player skill and sponsored gameplay at large and can or cannot be coupled to a RNG. In accordance with some embodiments, GWCs are player points earned or depleted as a function of player skill, specifically as a function of player performance in the context of the game. GWC is analogous to the score in a typical video game. Each entertainment game has one or more scoring criterion, embedded within the table Ln-GWC 116 that reflects player performance against the goal(s) of the game. GWCs can be carried forward from one level of sponsored gameplay to another, and ultimately paid out in various manners such as directly in cash, or indirectly such as by earning entrance into a sweepstakes drawing, or earning participation in, or victory in, a tournament with prizes. GWCs can be stored on a player tracking card or in a network-based player tracking system, where the GWCs are attributed to a specific player.

In accordance with certain embodiments, the operation of the GWE does not affect the RWE's gambling operation except for player choice parameters that are allowable in slot machines, including but not limited to, wager terms such as, but not limited to, a wager amount, how fast the player wants to play (by pressing a button or pulling the handle of a slot machine), and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RC available in the gambling game. The communication link can also convey a status operation of the RWE (such as on-line or tilt). The communication link can further communicate the various gambling control factors which the RWE 102 uses as input, such as the number of RC consumed per game or the player's election to enter a jackpot round. In FIG. 1, the GWE 112 is also shown as connecting to the player's user interface directly, as this can be utilized to communicate certain entertainment game club points, player status, control the selection of choices and messages which a player can find useful in order to adjust the entertainment game experience or understand their gambling status in the RWE 102.

In accordance with various embodiments of this invention, the ESE 120 manages and controls the visual, audio, and player control for the entertainment game. In accordance with certain embodiments, the ESE 120 accepts input from a player through a set of hand controls, and/or head, gesture, and/or eye tracking systems and outputs video, audio and/or other sensory output to a user interface. In accordance with many embodiments, the ESE 120 can exchange data with and accept control information from the GWE 112. In accordance with some of these embodiments, an ESE 120 can be implemented using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In accordance with some of these embodiments, ESE 120 can be an electromechanical game system of a draw certificate based gambling communicator hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 can send certain entertainment game control parameters and elements to the ESE 120 to affect its play, such as (but not limited to) what level of character to be using, changing the difficulty level of the game, changing the type of gun or car in use, and/or requesting potions to become available or to be found by the character. These game control parameters and elements can be based on a gambling outcome of a gambling game that was triggered by an element in the entertainment game being acted upon by the player. The ESE 120 can accept this input from the GWE 112, make adjustments, and continue entertainment game gameplay all the while running seamlessly from the player's perspective. The ESE's operation is mostly skill based, except for where the ESE's processes can inject complexities into the game by chance in its normal operation to create unpredictability in the entertainment game. Utilizing this interface, the ESE 120 can also communicate player choices made in the game to the GWE 112, such as but not limited to selection of a different gun, and/or the player picking up a special potion in the GW environment. The GWE's function in this architecture, being interfaced with the ESE 120, is to allow the transparent coupling of entertainment software to a fair and transparent random chance gambling game, providing a seamless perspective to the player that they are playing a typical popular entertainment game (which is skill based). In accordance with certain embodiments, the ESE 120 can be used to enable a wide range of entertainment games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In accordance with some embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RC in play, and amount of RC available. The RWE 102 can accept modifications in the amount of RC wagered on each individual gambling try, or the number of gambling games per minute the RWE 102 can execute, entrance into a bonus round, and other factors, all the while these factors can take a different form than that of a typical slot machine. An example of a varying wager amount that the player can choose can include, but is not limited to, gameplay with a more powerful character, a more powerful gun, or a better car. These choices can increase or decrease the amount wagered per individual gambling game, in the same manner that a standard slot machine player can decide to wager more or less credits for each pull of the handle. In accordance with some of these embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In accordance with a particular embodiment, the RWE 102 operation can be a game of chance as a gambling game running every 10 seconds where the amount wagered is communicated from the GWE 112 as a function of choices the player makes in the operation profile in the entertainment game.

In many embodiments, a gambling communicator hybrid game integrates a video game style gambling machine, where the gambling game (including an RWE 102 and RC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time, a rich environment of rewards to stimulate gamers can be established with the entertainment game. In accordance with some of these embodiments, the gambling communicator hybrid game can leverage very popular titles with gamers and provides a sea change environment for casinos to attract players with games that are more akin to the type of entertainment that a younger generation desires. In accordance with various embodiments, players can use their skill towards building and banking GWC that in turn can be used to win tournaments and various prizes as a function of their gamer prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In accordance with some embodiments, gambling communicator hybrid games also allow players to gain entry into subsequent competitions through the accumulation of game world credits (GWC) as a function of the user's demonstrated skill at the game. These competitions can pit individual players or groups of players against one another and/or against the casino to win prizes based upon a combination of chance and skill. These competitions can be either asynchronous events, whereby players participate at a time and/or place of their choosing, or they can be synchronized events, whereby players participate at a specific time and/or venue.

In accordance with some embodiments, one or more players engage in playing an entertainment game, resident in the ESE, the outcomes of which are dependent at least in part on skill. The gambling communicator hybrid game can include an entertainment game that includes head to head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

Figure 2:
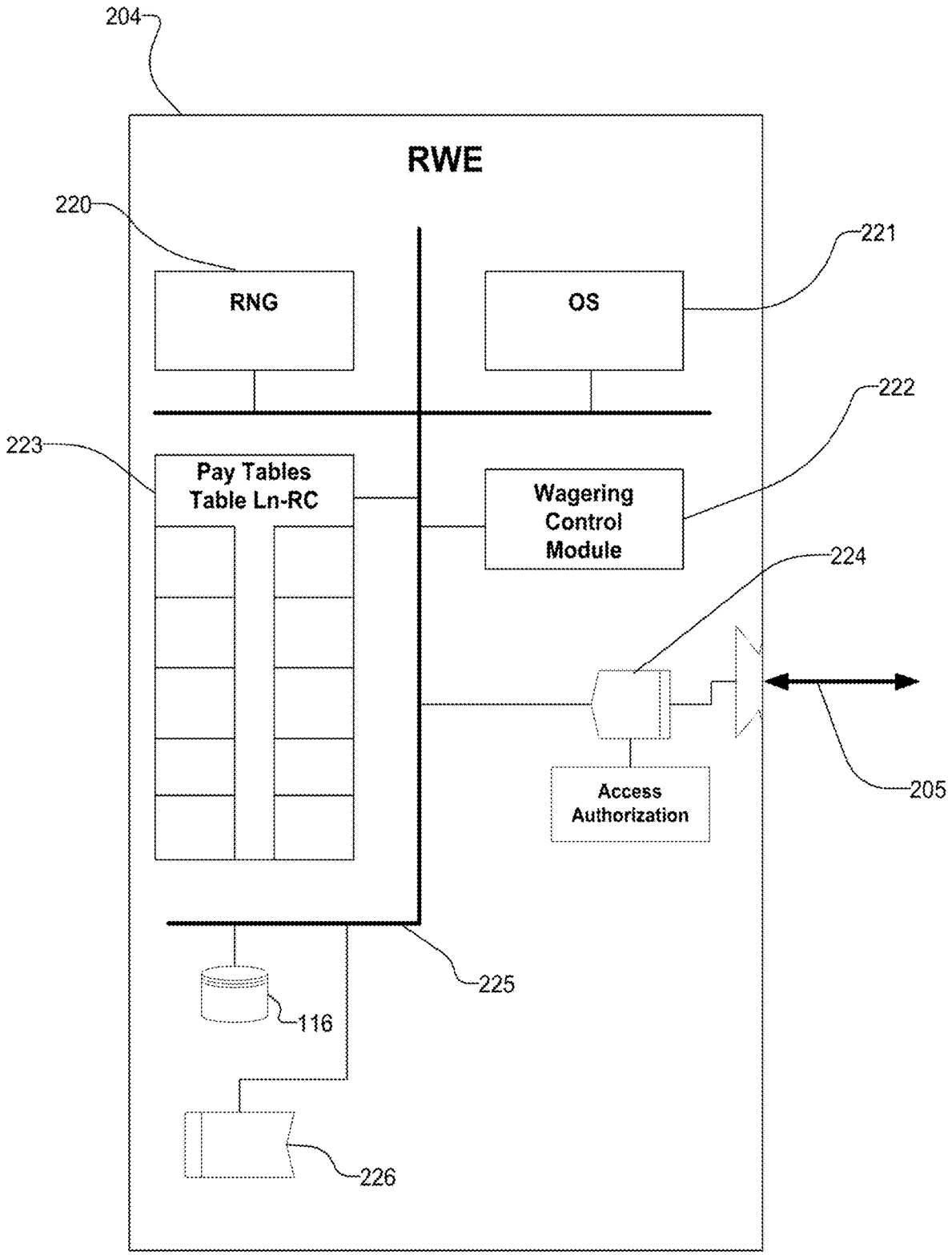
FIG. 2 illustrates a conceptual diagram of aspects of a Real World Engine (RWE) of a gambling communicator hybrid game in accordance with some embodiments of this invention.

The components provided by the RWE for a gambling communicator hybrid game in accordance with embodiments of this invention are shown in FIG. 2. In accordance with embodiments of this invention, the RWE includes an internal bus 225 that connects an operating system OS 221, a Random Number Generator ("RNG") 220, one or more pay tables (Table Ln-RC) 223 which would control the functions of the RWE, a Random Number Generator ("RNG") 220 to produce random numbers, one or more pay tables (Table Ln-RC) 223, a wagering control module 222, an authorization access module 224, and a RC credit meter 226 that are included in the RWE 204. The RW OS 221 controls the functions of the RWE. The RNG 220 includes one or more RNGs that are used to produce random numbers for use in resolving gambling events and other process requiring a random number to determine an outcome. The one or more pay tables (Table Ln-RC) 223 contain a plurality of factors indexed by the random number to be multiplied with the RC wagered to determine the payout on a successful wager. A wagering control module 222 performs the processes to resolve a wager on a proposition of a gambling event. The resolution process includes, but is not limited to, pulling random numbers, looking up factors in Pay Tables, multiplying the factors by the amount of RC wagered, and administering a RC credit meter 226. A repository (a credit meter) 926 maintains a record of the amount of RC which player has deposited in the game and has been accumulated by the player.

An external connection allows the RWE 204 to interface to another system or device, which is shown in FIG. 2 as the internet 205 but may be any other network and/or device. The authorization access module 224 of RWE 204 is connected to the external connection and provides a method to permit access and command exchange between an external system and the RWE 904. The RWE 904 also contains storage for statuses, wagers, wager outcomes, meters and other historical events in a storage device 116.

Figure 3:
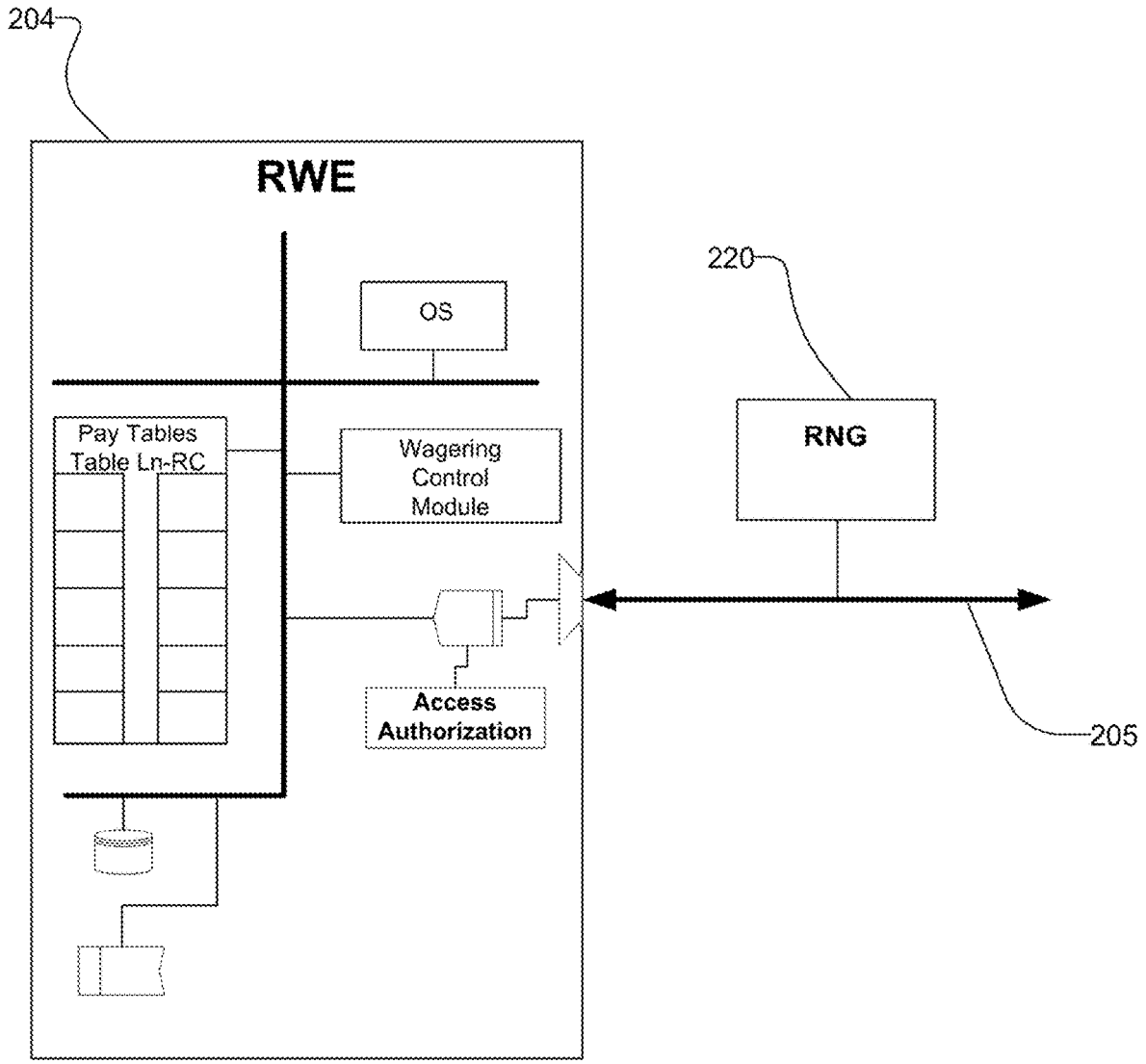
FIG. 3 illustrates a conceptual diagram of aspects of a Real World Engine of a gambling communicator hybrid game in accordance with some other embodiments of this invention.

In some embodiments, the RWE communicates with external systems to provide various functions of a gambling communicator hybrid game in accordance with embodiments of this invention. The components of an RWE that communicate with an external system to provide a component of the RWE in accordance with embodiments of this invention are shown in FIG. 3. The RWE 204 shown in FIG. 3 is similar to the RWE shown in FIG. 2. However, the RNG 220 which is an external system connected to the RWE 204 by the internet 905 in accordance with embodiments of this invention. The RNG 220 could be a central deterministic system, such as a regulated and controlled random numbered ball selection device, or some other system which provides random or pseudo random numbers to one or a plurality of connected RWEs 204. One skilled in the art will recognize that only RNG 220 is an external system in the shown embodiments. However, any of the components could be external systems without departing from this invention and RNG 220 is shown as an example only.

In FIGS. 2 and 3, the RWE 204 interfaces with other systems/devices or to an external RNG 220 using the Internet 205. However, one skilled in the art will note that nothing would preclude using a different interface than the internet 205 in other embodiments of this invention. Other examples of interfaces include, but are not limited to, a LAN, a USB interface, or some other method by which two electronic and software constructs could communicate with each other.

Figure 4:
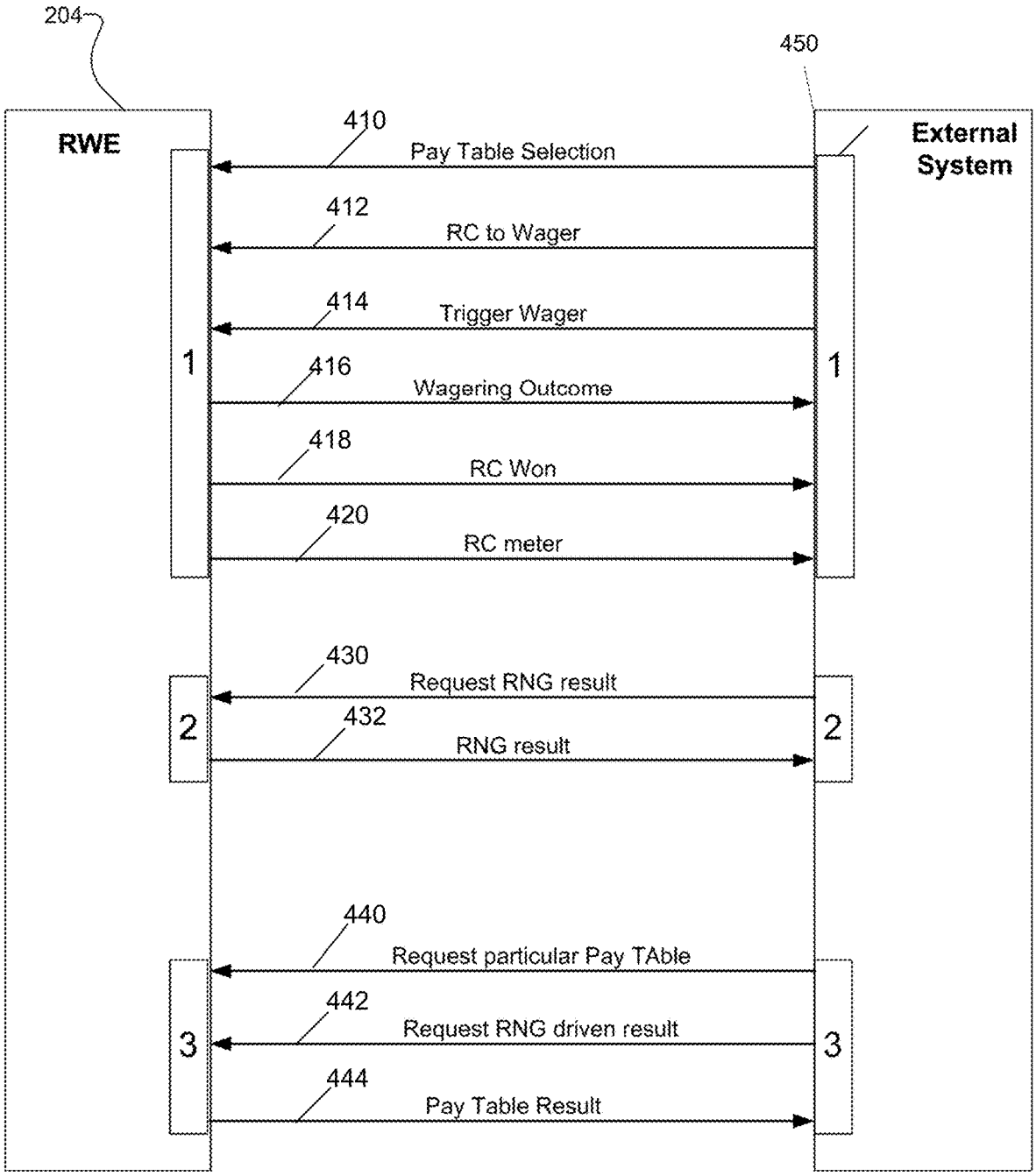
FIG. 4 illustrates a signaling diagram of communications between a Real World Engine (RWE) and an external system to provide various functions in accordance with embodiments of this invention.

The RWE and an external system typically communicate to provide the resolution of gambling events to resolve wagers on the events. The signals between the RWE and an external system to provide some process related to resolving gambling events in accordance with embodiments of this invention are shown in FIG. 4. In accordance with embodiments of this invention, the primary function of the RWE 204 is to manage wagering events and to provide random (or pseudo random) numbers from an RNG. At the top of the figure, a 6 component communication exchange grouped by the "1" box is shown for a wager on a proposition in a gambling event during a gambling communicator hybrid game in accordance with embodiments of this invention. An external system 450 that is requesting wagering support from the RWE 204 instructs the RWE 204 as to the pay table (Table Ln-RC) to use (410), followed by the amount of RC to wager on the proposition of the gambling event (412). Next, the external system 450 signals the RWE to trigger a wager or perform the gambling event (414). The RWE 204 resolves the gambling event. The RWE 204 then informs external system 450 as to the outcome of the wager (416), the amount of RC won (418), and the amount of RC in the player's account (in the credit repository) (420).

A second communication exchange between the RWE 204 and an external system 450 in accordance with embodiments of this invention that is shown in FIG. 4 is grouped by the "2" box in FIG. 4 and relates to the external system 450 needing an RNG result support from the RWE 204. In this exchange, the external system 450 requests an RNG result from the RWE 204 (430). The RWE 204 returns an RNG result to the external 450 in response to the request (432). The result may be generated as a function of the internal RNG in the RWE 204, or from an RNG external to the RWE 204 to which the RWE 204 is connected.

A third communication exchange between the RWE 204 and the external system 405 in accordance with embodiments of this invention that is shown in FIG. 4 is grouped by the "3" box in the figure and relates to the external system 450 wanting support on coupling an RNG result to a particular Pay Table contained in the RWE 204. In this exchange, the external system 450 instructs the RWE as to the pay table (Table Ln-RC) to use 450. The external system then requests a result whereby the RNG result is coupled to the requested Pay Table (442). The result is returned to the external system 405 by RWE 204 (444). Such an aspect is different from the first exchange shown by the box"1" sequence in that no actual RC wager is conducted. However, such a process t might be useful in coupling certain non-RC wagering entertainment game behaviors and propositions to the same final resultant wagering return which is understood for the gambling communicator hybrid game to conduct wagering.

In regards to FIG. 4, one skilled in the art will note that the thrust of the FIG. 4 is to convey overall functional exchanges between an RWE 204 and an external system 450. As such, various protocol layers necessary for error free and secure communication, and other status, setup, and configuration commands which one might expect in any protocol between two connected systems have been omitted for clarity. Furthermore, some or all of the various commands and responses illustrated could be combined into one or more communication packets without departing from this invention.

Figure 5:
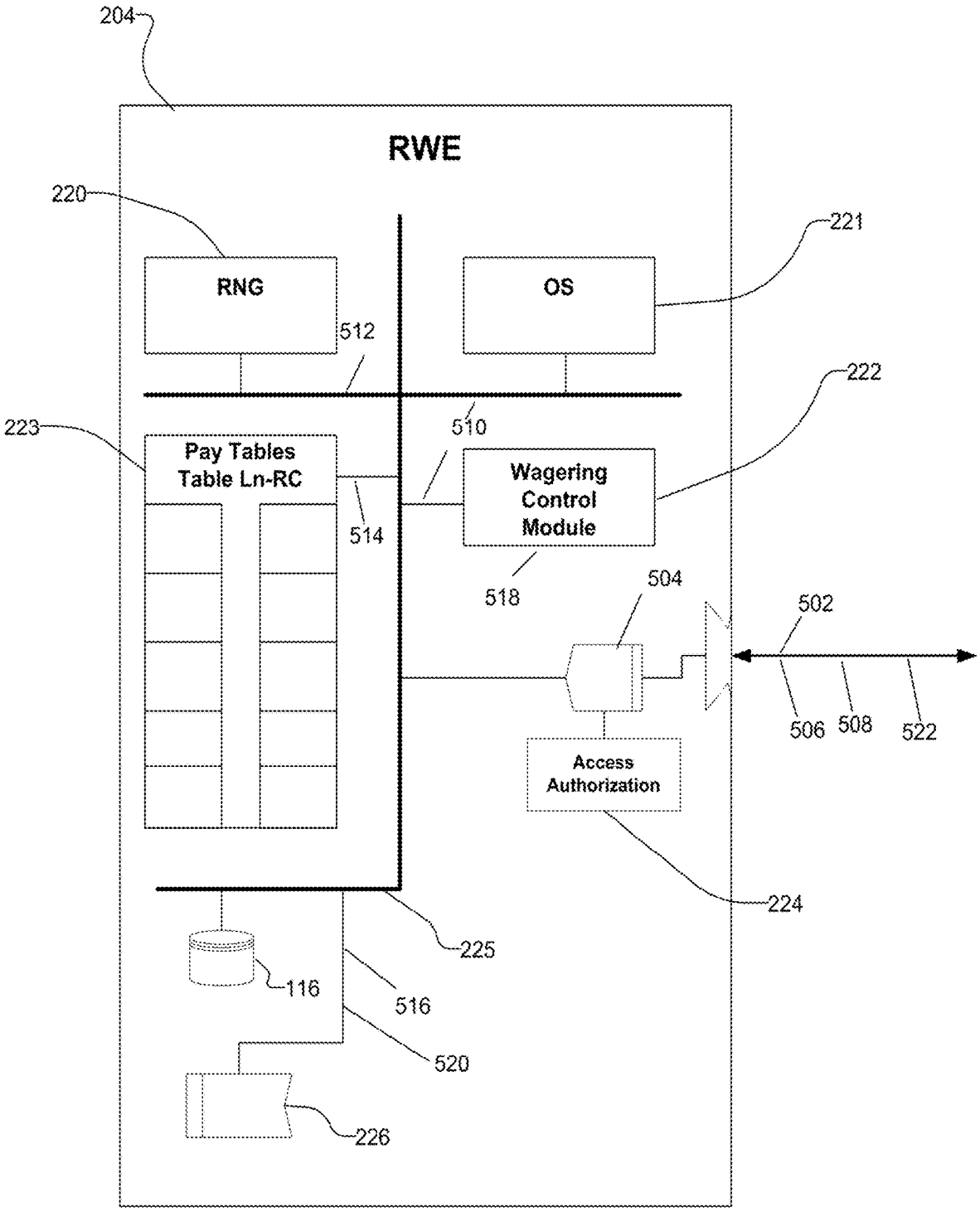
FIG. 5 illustrates a conceptual diagram of a process flow and signaling in an RWE to provide various functions in accordance with embodiments of this invention.

The process flow for functional communication exchanges, such as communication exchanges described above with reference to FIG. 4, between a RWE and an external system in accordance with embodiments of this invention are shown in FIG. 5. The process begins by a RWE 204 receiving signals from an external system requesting a connection to RWE 204. The Access Authorization Module determines that the external system authorized to connect to RWE 204 (504) and transmits an authorization response to the external system. The external systems that provide requests a request for a gambling event is to be performed to RWE 294 (506). The request may include an indication of a wager amount on a proposition in the gambling event, and a proper pay table to use to resolve the wager. The external system then sends a signal to trigger the gambling event (508).

The OS 221 instructs the Wager Control Module 222 as to the RC wager and the Pay Table to select as well as to resolve the wager execute (510). In response to the request to execute the gambling event, the wager control module 222 requests an RNG result from the RNG 220 (512); retrieves a proper pay table or tables from the pay tables 223 (514); adjusts the RC of the player in the RC repository 926 as instructed (516; applies the RNG result to the particular pay table or tables (518); and multiplies the resultant factor from the Pay Table by the amount of RC to determine the result of the wager (518). Wager Control Module 222 then adds the amount of RC won by the wager to the RC repository 426 (520); and provides he outcome of the wager, and the amount of RC in the RWE and the RC won (522). One skilled in the art will recognize that there may be many embodiments of an RWE 204 which could be possible, including forms where many modules and components of the RWE are located in various servers and locations, so the foregoing is not meant to be exhaustive or all inclusive, but rather provide information about an RWE 204 in accordance with some embodiments of this invention.

Figure 6:
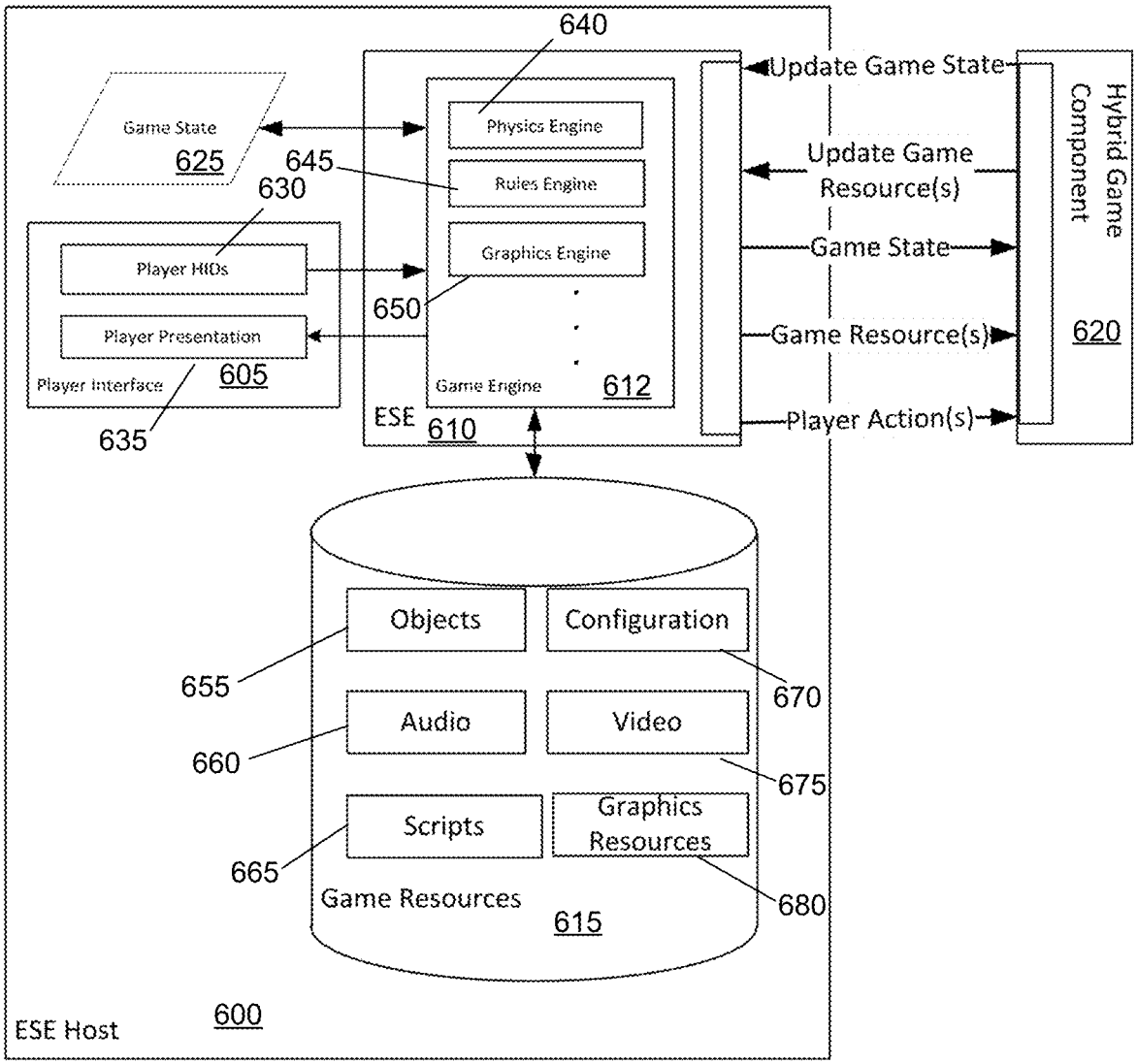
FIG. 6 illustrates a conceptual diagram of aspects of an Entertainment System Engine in accordance with embodiments of this invention.

A block diagram of components an ESE being provided by an ESE host for a gambling communicator hybrid game in accordance with embodiments of this invention are shown in FIG. 6. An ESE 610 may be part of the entertainment game itself, may be a software module that is executed by the entertainment game, or may provide an execution environment for the entertainment game for a particular host. The ESE 610 and associated entertainment game are hosted by an ESE host 600. The ESE host 600 is a computing device that is capable of hosting the ESE 610 and the entertainment game. Exemplary hosts include video game consoles, smart phones, personal computers, tablet computers, or the like. The entertainment game includes a game engine 612 that generates a player interface 605 for interaction with by a player. The player interface includes a player presentation 635 that is presented to a player through the player interface. The player presentation 635 may be audio, visual or tactile, or any combination of such. The player interface 635 further includes one or more Human Input Devices (HIDs) 630 that the player uses to interact with the entertainment game. Various components or sub-engines of the game engine read data from a game state in order to implement the features of the game. Components of the game engine include a physics engine 640 used to simulate physical interactions between virtual objects in the game state, a rules engine 645 for implementing the rules of the game, an RNG that may be used for influencing or determining certain variables and/or outcomes to provide a randomizing influence on game play, a graphics engine 650 used to generate a visual representation of the game state to the player, an audio engine to generate audio outputs for the player interface, and any other engine needed to provide the entertainment game. The game engine 612 reads and writes game resources 615 stored on a data store of the ESE host. The game resources 615 include game objects 655 having graphics and/or control logic used to implement game world objects of the game engine. The game resources 615 also include video files 675 that are used to generate cut-scenes for the entertainment game. The game resources 615 may also include audio files 660 used to generate music, sound effects, etc. within the entertainment game. The game resources 615 may also include configuration files 670 used to configure the features of the entertainment game. The game resources 615 may also include scripts 665 or other types of control code used to implement various game play features of the entertainment game. The game resources 615 may also include graphics resources 680 including, but not limited to, textures, and objects that are used by the game engine to render objects displayed in the entertainment game.

In operation, components of the game engine 612 read portions of the game state 625 and generate the player presentation for the player which is presented to the player using the player interface 605. The player perceives the presentation 635 and provides player inputs using the HIDs 630. The corresponding player inputs are received as player actions or inputs by various components of the game engine 612. The game engine translates the player actions into interactions with the virtual objects of the game world stored in the game state 625. Components of the game engine 612 use the player interactions with the virtual objects of the game and the game state 625 to update the game state 625 and update the presentation 635 presented to the user. The process loops in a game loop continuously while the player plays the game.

The ESE 610 provides one or more interfaces between an entertainment game and other components 620 of a gambling communicator hybrid game, such as a GWE. The ESE 610 and the other hybrid game component 620 communicate with each other using the interfaces, such as by passing various types of data and sending and receiving messages, status information, commands and the like. Examples of communications include, but are not limited to, requesting by the hybrid game component 620 that the ESE 610 update the game state using information provided by the other component; requesting, by the hybrid game component 620, that the ESE 610 update one or more game resources using information provided by the hybrid game component 620; the ESE 610 providing all or a portion of the game state; the ESE 610 providing one or more of the game resources to the hybrid game component 620; and the ESE 610 communicating player actions to the other hybrid game component 620. The player actions may be low level player interactions with the player interface, such as manipulation of an HID, or may be high level interactions with objects as determined by the entertainment game. The player actions may also include resultant actions such as modifications to the game state or game resources resulting from the player's actions taken in the game. Other examples of player actions include actions taken by entities, such as Non-Player Characters (NPC) of the entertainment game, that act on behalf of, or under the control of, the player.

Elements are a limited resource consumed within an entertainment game to advance entertainment game gameplay. In playing the entertainment game using the elements, a player can (optionally) consume and accrue game world credits (GWC) within the entertainment game. These credits can be in the form of (but are not limited to) game world credits, experience points, or points generally. Wagers can be made in the gambling game as triggered by the player's use of one or more elements of the entertainment game. The wagers are made using real world credits (RC). The real world credits can be credits in an actual currency, or can be credits in a virtual currency which has real world value. Gambling outcomes from the gambling game can cause consumption, loss or accrual of RC. In addition, gambling outcomes in the gambling game can influence elements in the entertainment game such as (but not limited to) by restoring a consumed element, causing the loss of an element, restoration or placement of a fixed element. In certain embodiments, gambling games can facilitate the wager of GWC for a randomly generated payout of GWC or a wager of elements for a randomly generated payout of elements. In particular embodiments, an amount of GWC and/or elements used as part of a wager can have a RC value if cashed out of a gameplay session.

Example elements include enabling elements (EE) which are elements that enable a player's play of the entertainment game and whose consumption by the player while playing the entertainment game can trigger a wager in a gambling game. Another non limiting example of an element is a reserve enabling element (REE), which is an element that converts into one or more enabling elements upon occurrence of a release event in skill wagering interleaved game gameplay. Other types of elements include actionable elements (AE) which are elements that are acted upon to trigger a wager in the gambling game and may or may not be restorable during normal play of the entertainment game. Another type of element is a common enabling element (CEE) which as an element that may be shared by two or more players and the use of which by any of the players causes a wager to be triggered.

In progressing through entertainment game gameplay, elements can be utilized by a player during interactions with a controlled entity (CE) which is a character, entity, inanimate object, device or other object under control of a player.

Also, entertainment game gameplay progress and wager triggers can be dependent upon a game world variable such as, but not limited to: a required game object (RGO) which is a specific game object in an entertainment game acted upon for an AE to be completed (such as but not limited to a specific key needed to open a door); a required environmental condition (REC) which is a game state present within an entertainment game for an AE to be completed (such as but not limited to daylight whose presence enables a character to walk through woods); or a controlled entity characteristic (CEC) which is a status of the CE within an entertainment game for an AE to be completed (such as but not limited to a CE to have full health points before entering battle). Although various gameplay resources, such as but not limited to GWC, RC and elements as discussed above, any gameplay resource can be utilized to advance gameplay as well as form the basis for a trigger of a wager as appropriate to the specification of a specific application in accordance with various embodiments of the invention. Various hybrid games are discussed in PCT Application Nos. PCT/US11/26768, filed Mar. 1, 2011, PCT/US11/63587, filed Dec. 6, 2011, and PCT/US12/50204 filed Aug. 9, 2012, each disclosure of which is hereby incorporated by reference in its entirety.

Figure 7:
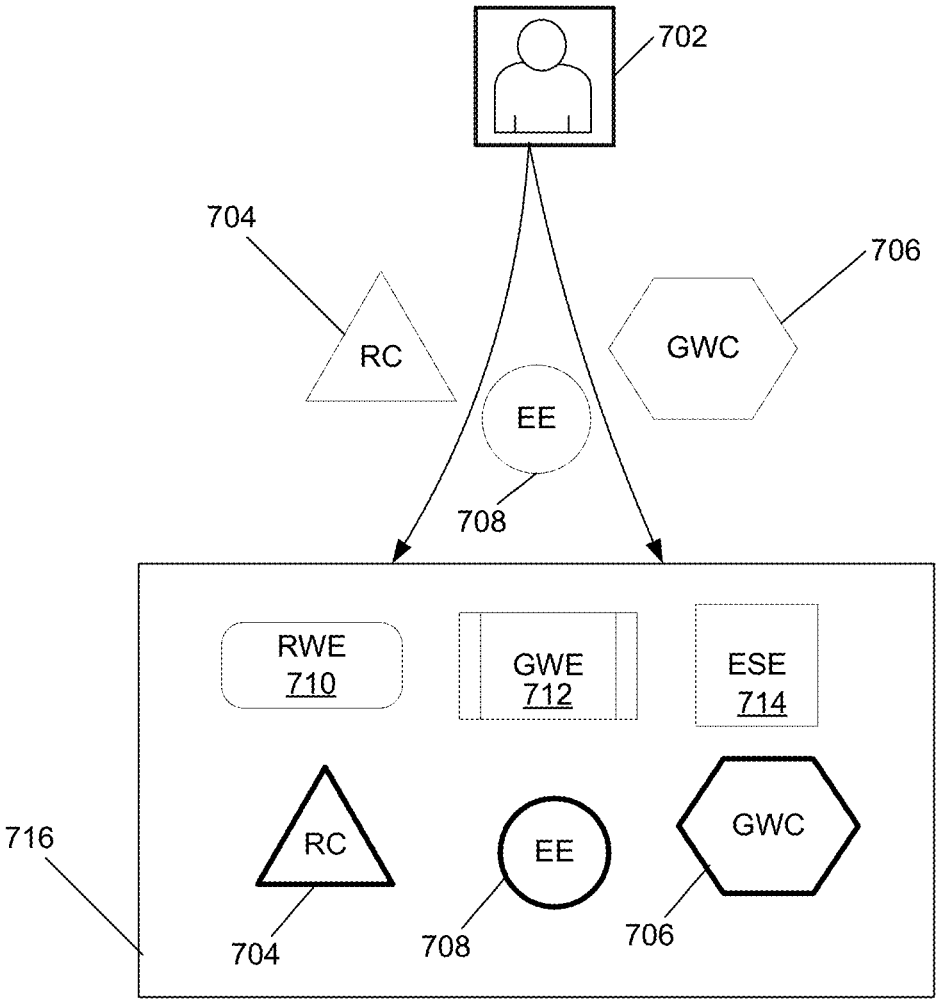
FIG. 7 illustrates a conceptual diagram of interactions between a user and a gambling communicator hybrid game in accordance with embodiments of the invention.

In accordance with some embodiments, a player can interact with a gambling communicator hybrid game by using RC in interactions with a gambling game along with GWC and elements in interactions with an entertainment game. The gambling game can be executed by a RWE while an entertainment game can be executed with an ESE and managed with a GWE. A conceptual diagram that illustrates how resources such as GWC, RC and elements, such as but not limited to enabling elements (EE), are utilized in a gambling communicator hybrid game in accordance with an embodiment of the invention is illustrated in FIG. 7. The conceptual diagram illustrates that RC 704, EE 708 and GWC 706 can be utilized by a player 702 in interactions with the RWE 710, GWE 712 and ESE 714 of a based gambling communicator hybrid game 716. The contribution of elements, such as EE 708, can be linked to a player's access to credits, such as RC 704 or GWC 706. Electronic receipt of these credits can come via a smart card, voucher or other portable media, or as received over a network from a server. In accordance with certain embodiments, these credits can be drawn on demand from a player profile located in a database locally on a gambling communicator hybrid game or in a remote server.

Figure 8:
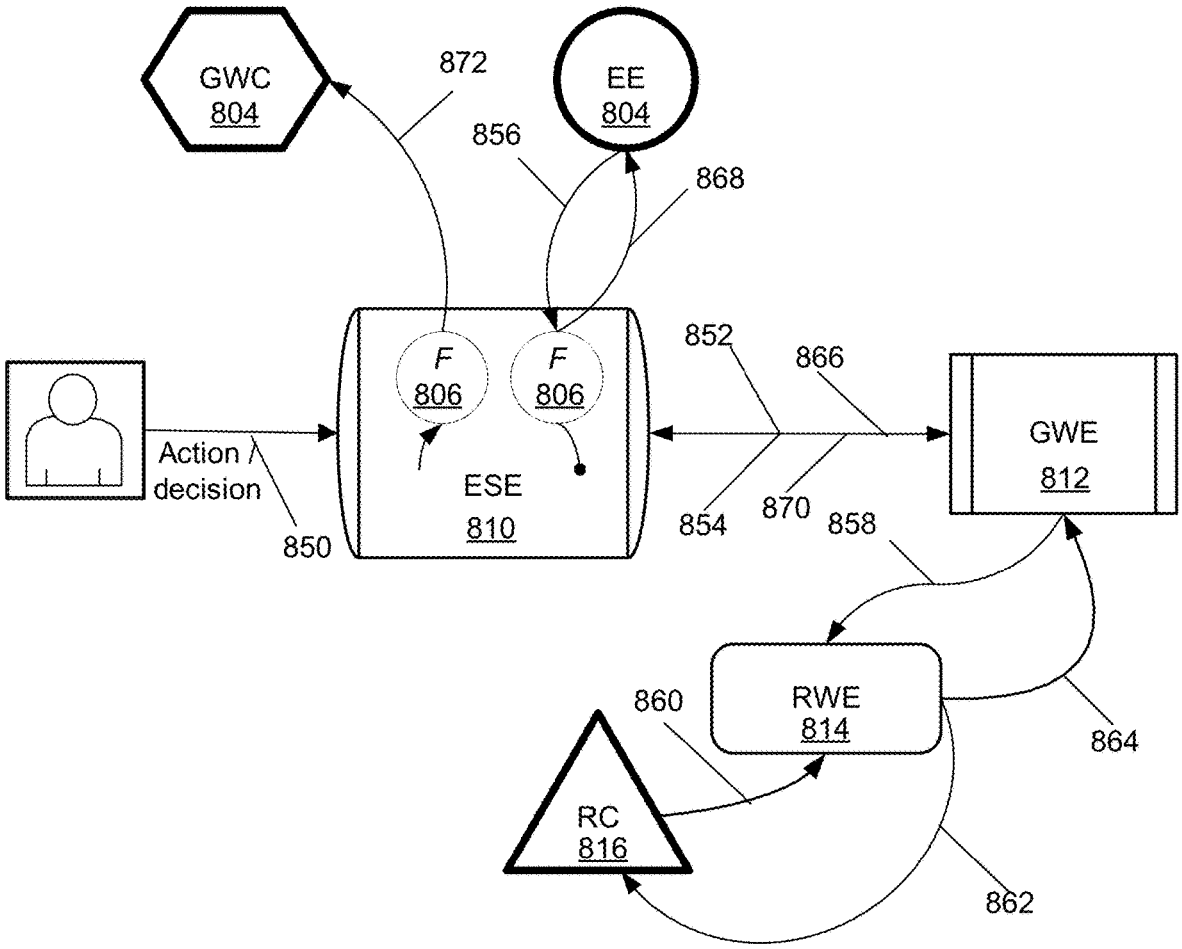
FIG. 8 illustrates conceptual diagram that illustrates the interplay between aspects of a gambling communicator hybrid game in accordance with some embodiments of the invention using Real World Currency (RC).

A conceptual diagram that illustrates the interplay between aspects of a gambling communicator hybrid game in accordance with an embodiment of the invention using Real World Currency (RC) is illustrated in FIG. 8. Similar to FIG. 7, a player's actions and/or decisions can affect functions 806 that consume and/or accumulate GWC 802 and/or EE 804 in an entertainment game executed by an ESE 810. A GWE 812 can monitor the activities taking place within an entertainment game executed by an ESE 810 for gameplay gambling event occurrences. The GWE 812 can also communicate the gameplay gambling event occurrences to an RWE 814 that triggers a wager of RC 816 in a gambling game executed by the RWE 814.

In accordance with some embodiments of the invention, the following may occur during use of the gambling communicator hybrid game. The user enters an input that represents an action or decision (850). The ESE 810 signals the GWE 812 with the input decision or action (852). The GWE 812 responds by signaling to ESE 810 with the amount of EE that is consumed by the player action or decision (854). The signaling from the GWE 812 configures a function 806 to control the EE consumption, decay, and/or accumulation.

The ESE 810 then adjusts the EE 804 accordingly (856). The GWE 812 signals the RWE 814 as to the profile of the wager proposition associated with the action or decision and triggers the wager (858). The RWE 814 consumes the appropriate amount of RC 816 and executes the wager (860). The RWE 814 then adjusts the RC 816 based upon the outcome of the wager (862) and informs the GWE 812 as to the outcome of the wager (864).

The GWE 812 signals the ESE 810 to adjust EE to one or more of the EEs of the ESE entertainment game (866). Function 806 of the ESE 810 performs the adjustment of EE 804 (868). The ESE 810 signals the GWE 812 as to the updated status (870). In response, the GWE 812 signals the ESE 810 to update GWC of the entertainment game. The ESE updates the GWC 802 using a function 806 (872).

The following is an example of the above flow in a first person shooter game, such a Call of Duty®, using a gambling communicator hybrid game sequence in accordance with embodiments of this invention.

The process begins by a player selecting a machine gun to use in the game and then fires a burst of bullets at an opponent (850). The ESE 810 signals the GWE 812 of the player's choice of weapon, that a burst of bullets was fired, and the outcome of the burst (852). GWE 812 processes the information received and signals ESE 810 to consume 3 bullets (EE) with each pull of the trigger (854). The ESE 810 consumes 3 bullets for the burst using function 806 (856).

The GWE 812 signals the RWE 814 that 3 credits (RC) are to be wagered to match the three bullets consumed. The RWE 814 then determines the result of the wager and may determine the winnings from a pay table. On a particular pay table (Table Ln-RC), a determination is made by RWE 814 as to the amount of damage that the opponent has sustained. The RWE 814 consumes 3 credits of RC 816 for the wager and executes the specified wager (860). The RWE 814 determines that the player hit a jackpot of 6 credits and returns the 6 credits to the RC 816 (862) and signals the GWE 812 that 3 net credits were won by the player (864).

The GWE 812 signals ESE 810 to add 3 bullets to an ammunition clip (866). ESE 810 adds 3 bullets back to the ammo clip (EE 804) using a function 806 (868). The ammunition may be added by directly adding the ammunition to the clip or by allowing the user to find extra ammunition during game play. The GWE 812 logs the new player score (GWC 802) in the game (as a function of the successful hit on the opponent) based on the ESE 810 signaling, and the signals the ESE 810 to add 2 extra points to the player score since a jackpot has been won (870). The ESE 810 then adds 10 points to the player score (GWC 802) given the success of the hit which in this example is worth 8 points, plus the 2 extra points requested by GWE 812 (872). Note that the foregoing example is only intended to provide an illustration of how credits flow in a gambling communicator hybrid game, but is not intended to be exhaustive and only lists only one of numerous possibilities of how a gambling communicator hybrid game may be configured to manage its fundamental credits.

Figure 9:
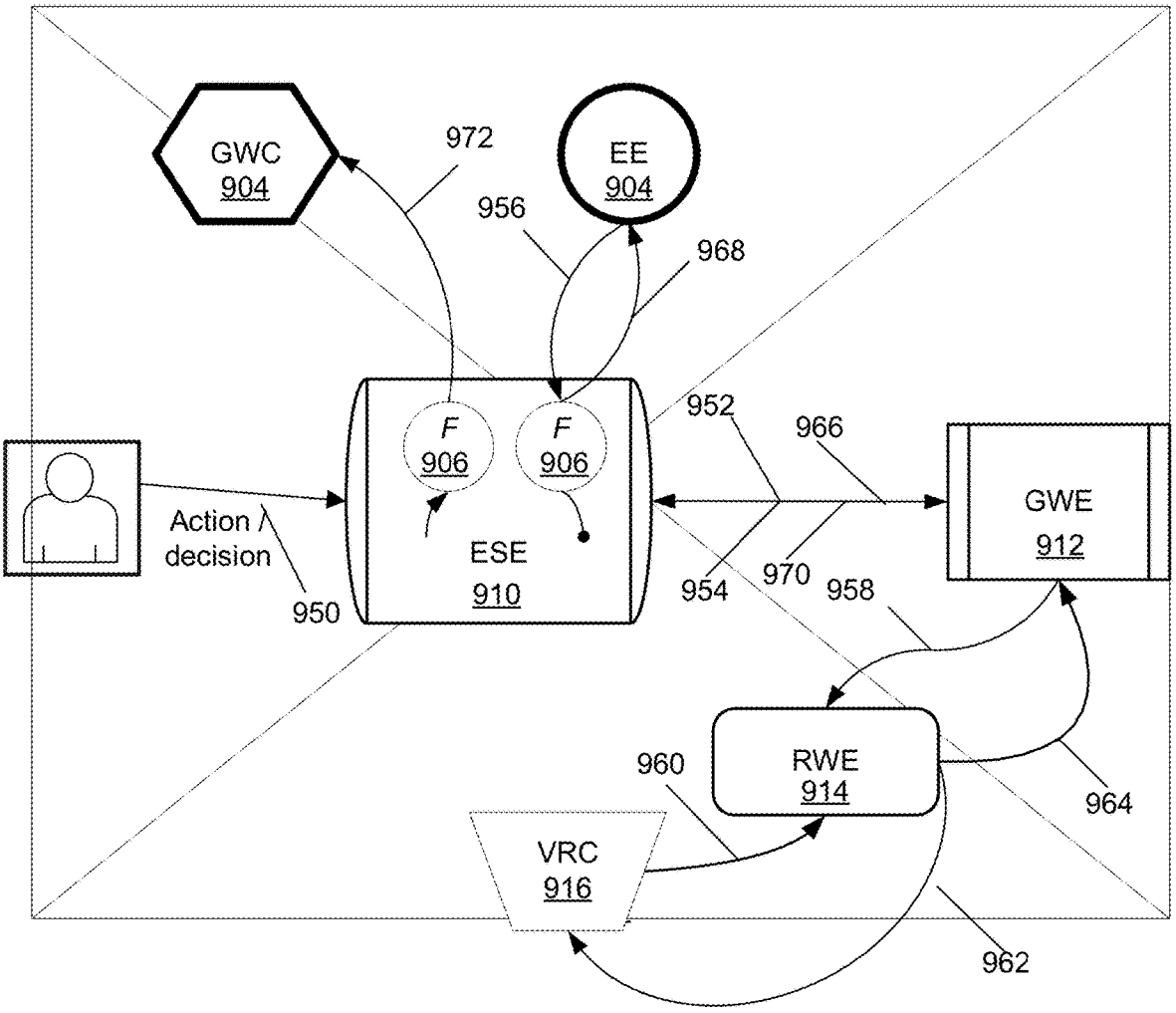
FIG. 9 illustrates conceptual diagram that illustrates the interplay between aspects of a gambling communicator hybrid game in accordance with other embodiments of the invention using Virtual Real World Currency (VRC).

A conceptual diagram that illustrates the interplay between aspects of a gambling communicator hybrid game in accordance with an embodiment of the invention using Virtual Real World Currency (VRC) is illustrated in FIG. 9. As seen in the FIG. 9, substituting VRC in place of RC is effected without impact to the architecture or operation of the gambling communicator hybrid game. The implementation of FIG. 9 is not the only embodiment using virtual currency within a Hybrid Game, but shows only one permutation of which many could exist.

Similar to FIG. 8, a player's actions and/or decisions can affect functions 906 that consume and/or accumulate GWC 902 and/or EE 904 in an entertainment game executed by an ESE 910 in the process shown in FIG. 9. A GWE 912 can monitor the activities taking place within an entertainment game executed by an ESE 910 for gameplay gambling event occurrences. The GWE 912 can also communicate the gameplay gambling event occurrences to a RWE 914. Unlike the process shown in FIG. 8, RWE 914 triggers a wager of Virtual Real World Currency (VRC) 916 in a gambling game executed by the RWE 914.

For purposes of this discussion, VRC can be thought of as a form of alternate currency, which can be acquired, purchased or transferred, in unit or in bulk, by/to a player, but does not necessarily directly correlate to RC or real currency. As an example, there is a virtual currency called "Triax Jacks", 1000 units of which are given to a player by an operator of a gambling communicator hybrid game, with additional blocks of 1000 units being available for purchase for $5 USD each block. Triax Jacks could be redeemed for various prizes, or could never be redeemed but simply used and traded purely for entertainment value by players. It would be completely consistent with the architecture of the gambling communicator hybrid game that Triax Jacks would be wagered in place of RC, such that the gambling communicator hybrid game could be played for free, or with played with operator sponsored Triax Jacks.

Returning to the process in FIG. 9, the following may occur during use of the gambling communicator hybrid game in accordance with embodiments of this invention. The user enters an input that represents an action or decision (950). The ESE 910 signals the GWE 912 with the input decision or action (952). The GWE 912 responds by signaling to ESE 910 with the amount of EE that is consumed by the player action or decision (954). The signaling from the GWE 912 configures a function 906 to control the EE consumption, decay, and/or accumulation.

The ESE 910 then adjusts the EE 904 accordingly (956). The GWE 912 signals the RWE 914 as to the profile of the wager proposition associated with the action or decision and triggers the wager (958). The RWE 914 consumes the appropriate amount of RC 916 and executes the wager (960). The RWE 914 then adjusts the RC 916 based upon the outcome of the wager (962) and informs the GWE 912 as to the outcome of the wager (964).

The GWE 912 signals the ESE 910 to adjust EE to one or more of the EEs of the ESE entertainment game (966). Function 906 of the ESE 910 performs the adjustment of EE 904 (968). The ESE 910 signals the GWE 912 as to the updated status (970). In response, the GWE 912 signals the ESE 910 to update GWC 902 of the entertainment game. The ESE updates the GWC 902 using a function 906 (972).

Network Based Gambling Communicator Hybrid Game

Figure 10:
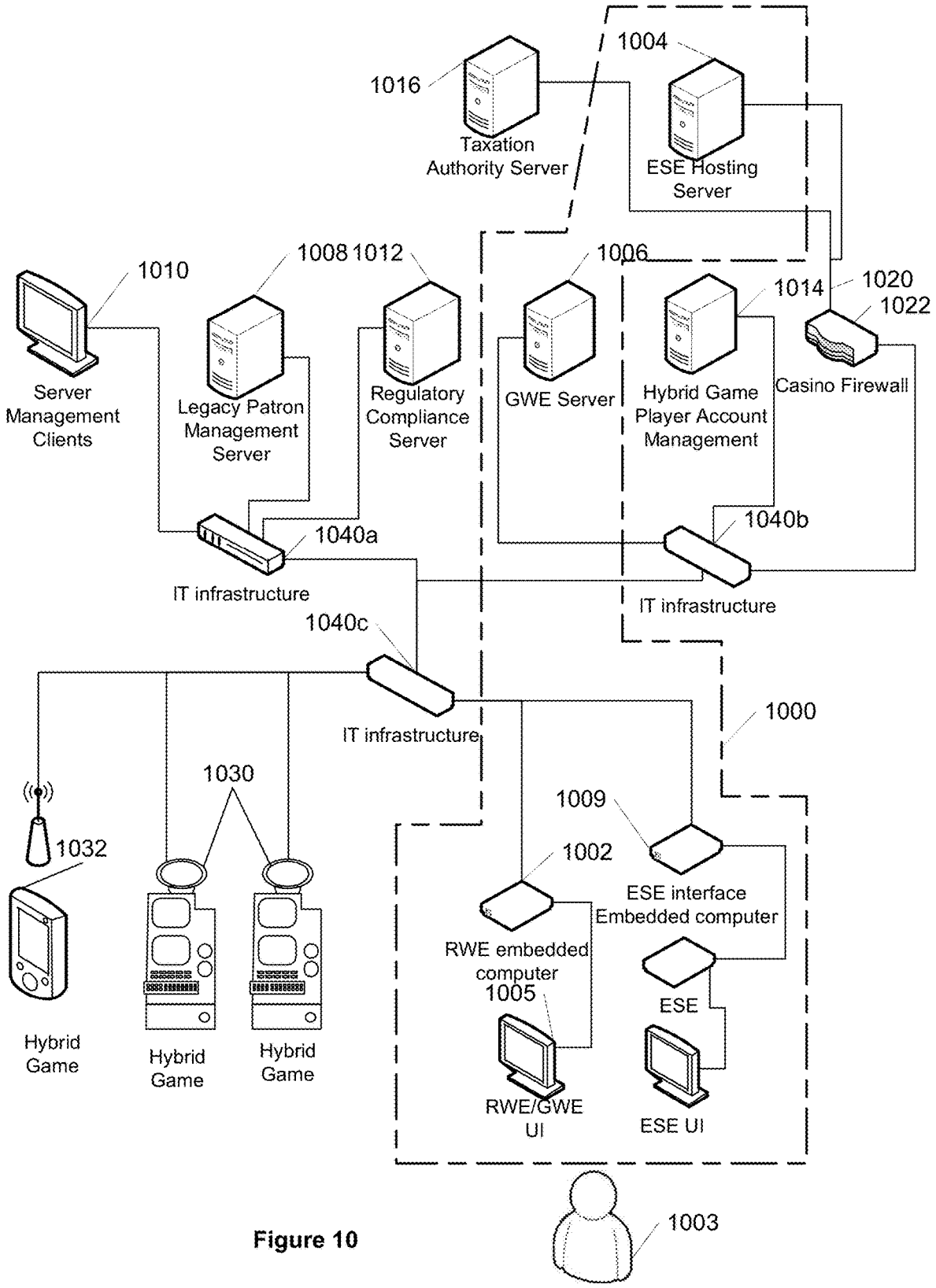
FIG. 10 illustrates a system diagram of an implementation of a network based gambling communicator hybrid game in accordance with another embodiment of this invention.

A system diagram that illustrates an implementation of a network distributed gambling communicator hybrid game with a GWE local server in accordance with embodiments of the invention is illustrated in FIG. 10. In the figure, the hybrid game 1000 includes components, RWE 1002 embedded in a device used as the user interface for player 1003. The device provides both a RWE/GWE user interface 1005 and an ESE user interface 1007 for the player. The ESE is provisioned by an ESE hosting server 1004 via ESE interface 1009, and the GWE is provisioned by GWE server 1006 as indicated by the dashed line. Also pictured in the diagram are a number of other peripheral systems, such as player management 1008, casino management 1010, regulatory 1012, hybrid game player account management 1014, and taxation authority 1016 hosting servers that may be present in such an implementation. FIG. 10 also illustrates various other systems, which may reside outside the bounds of the casino and are connected to the framework via communications network, such as the Internet 1020, depicted by the connection lines past the casino firewall 1022. The end devices utilized for user interfaces for a hybrid game include, but are not limited to, casino electronic game machines 1030 and wireless or portable devices, such as smart phone 1032, personal digital assistants, tablet computers, video gaming consoles or the like. These disparate devices are connected within and without the casino through the casino's information technology structure as illustrated by routers 1040*a*, 1040*b* and 1040*c*. It should be understood that FIG. 10 does not attempt to illustrate all servers and systems to which a hybrid game 1000 might be inevitably be connected, and indeed one might expect there would be others, but rather provides an example of a set of a sub-set of systems which would be present in an exemplary embodiment of an installation.

Figure 11:
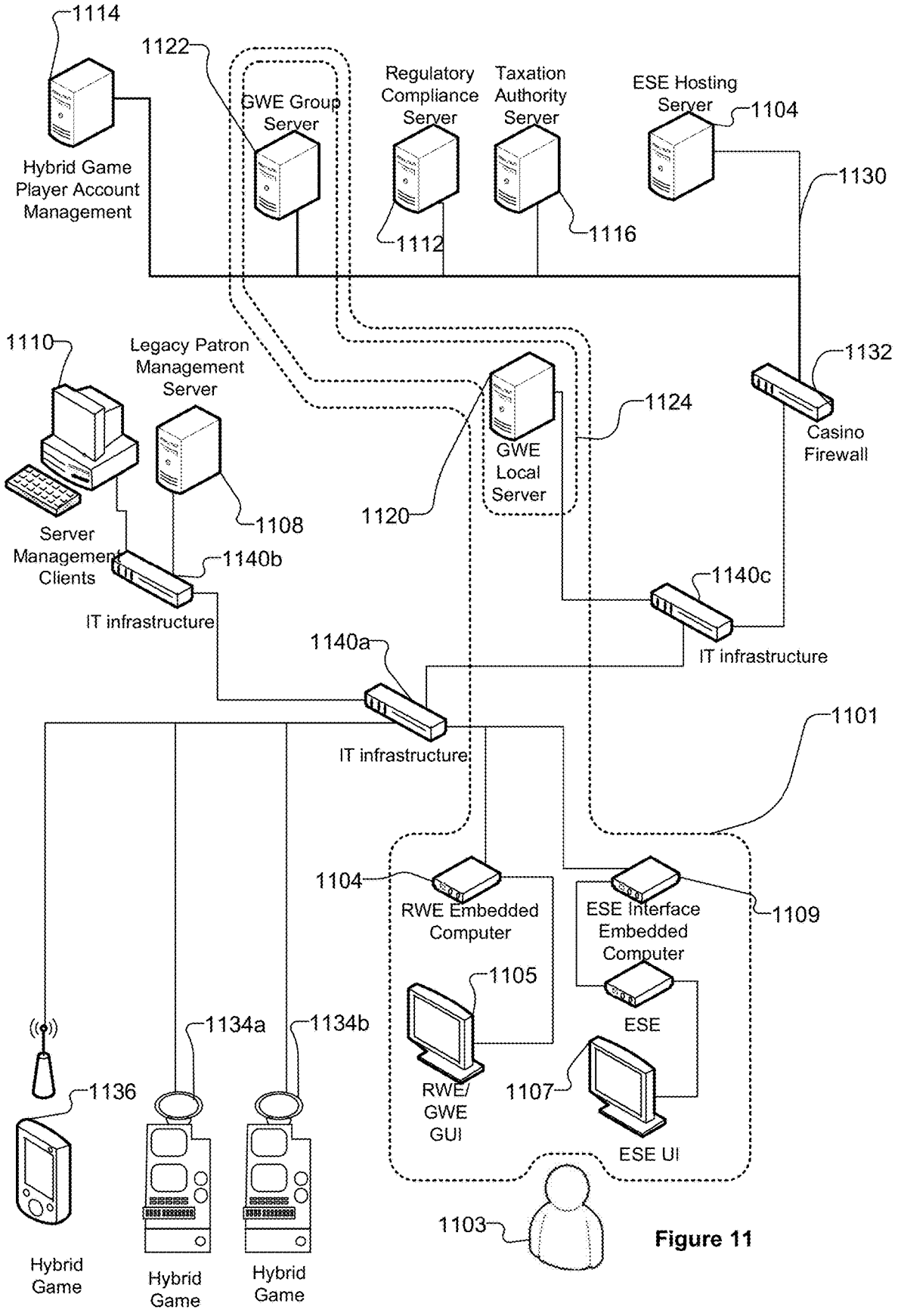
FIG. 11 illustrates a system diagram of an implementation of an Internet based gambling communicator hybrid game in accordance with an embodiment of the invention.

FIG. 11 is a diagram showing another implementation of a hybrid game in accordance with an exemplary embodiment. In the figure, the hybrid game 1101 includes components, RWE 1104 embedded in a device used as the user interface for player 1103. The device provides both a RWE/GWE user interface 1105 and an ESE user interface 1007 for the player. The ESE is provisioned by an ESE hosting server 1104 via ESE interface 1109. Also pictured in the diagram are a number of other peripheral systems, such as player management 1108, casino management 1110, regulatory 1112, hybrid game player account management 1114, and taxation authority 1116 hosting servers that may be present in such an implementation. In the figure, note that the GWE is composed of two sub-components, a local GWE server 1120, and a cloud server 1122. (components within the dash line area 1124). In the figure, certain of the components are located within the bounds of the casino, namely the RWE, the ESE and a portion of the GWE, namely the local GWE server 1120. The Cloud Server GWE 1122 is located in the cloud connected to the casino bounded hybrid game components via communications network such as the Internet 1130 through a firewall 1132. FIG. 11 also illustrates various other systems, which may reside outside the bounds of the casino and are connected to the framework via communications network. The end devices utilized for user interfaces for a hybrid game include, but are not limited to, casino electronic game machines, 1134*a* and 1134*b*, and wireless or portable devices, such as smart phone 1136, personal digital assistants, tablet computers, video gaming consoles or the like. These disparate devices are connected within and without the casino through the casino's information technology structure as illustrated by routers 1140*a*, 1140*b* and 1140*c*. It should be understood that FIG. 11 does not attempt to illustrate all servers and systems to which a hybrid game might be inevitably be connected, and indeed one might expect there would be others, but rather provides an example of a set of a sub-set of systems which would be present in an exemplary embodiment of an installation.

Figure 12:
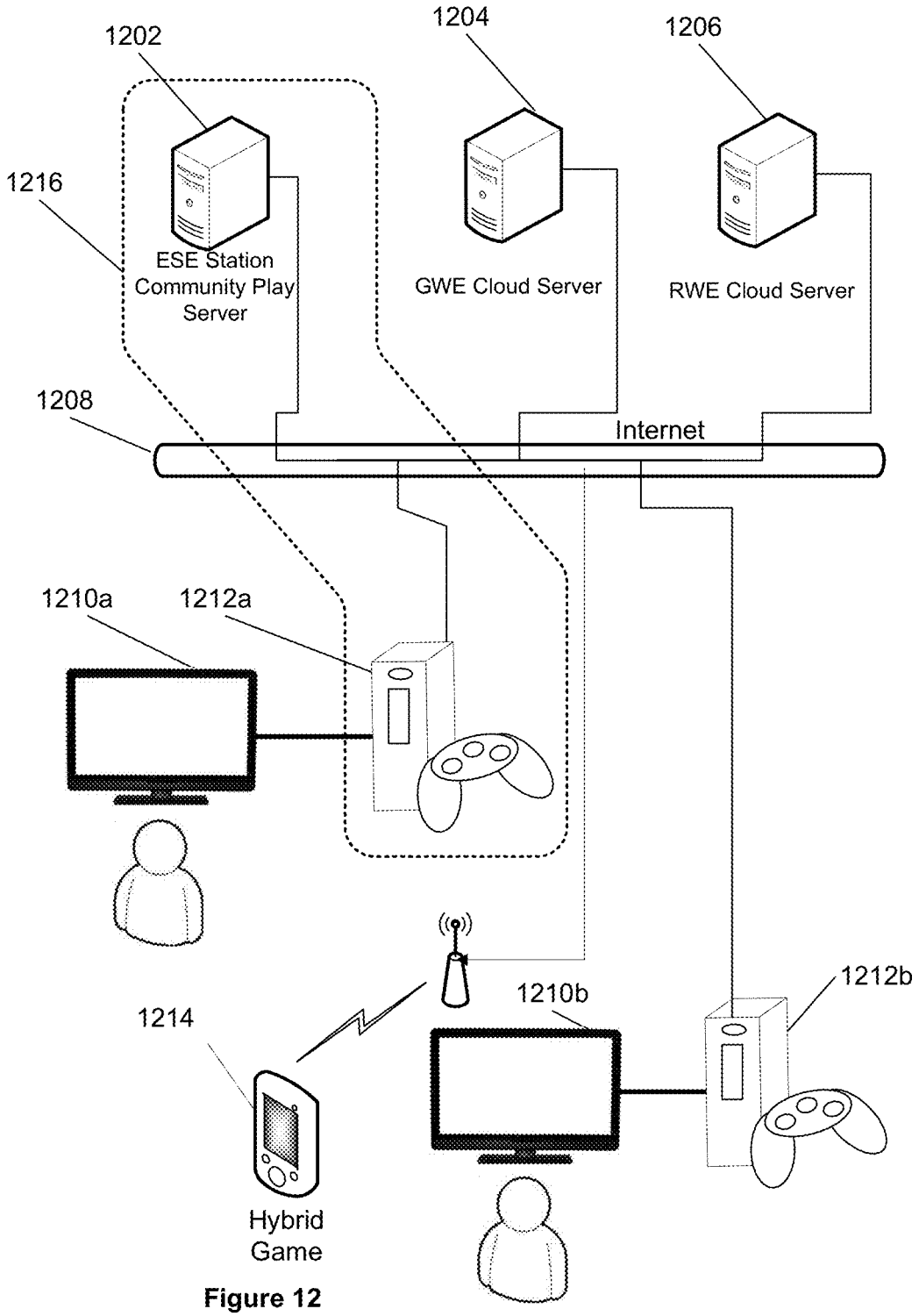
FIG. 12 illustrates a system diagram of an implementation of a cloud based gambling communicator hybrid game in accordance with embodiments of this invention.

A system diagram that illustrates an implementation of network a cloud based hybrid game over the Internet in accordance with an embodiment of the invention is illustrated in FIG. 12. The system includes an ESE server 1202, GWE server 1204 and RWE server 1206 that each connect to a user interface, 1210*a* or 1210*b*, (such as, but not limited to, a television screen, computer terminal, tablet, touchscreen or PDA) of hybrid games over the Internet 1208. Each gambling hybrid game includes a local ESE 1212*a* or 1212*b* (such as, but not limited to, a video game console or a gaming computer system) that interfaces with a remote ESE server 1002. Processes performed by an ESE 1212*a* services can be performed in multiple locations, such as, but not limited to, remotely on an ESE server 1202 and locally on a local ESE 1212*a*. In addition, a gambling hybrid game may include a Personal Digital Assistant (PDA) 1214 or other type of mobile computing device game coupled to the ESE hosting server 1202, thus providing the opportunity for a player to play a hybrid game on the PDA through a mobile phone or data network.

There are many possible permutations of how a hybrid game could be constructed, with FIGS. 10, 11 and 12 showing only three possible permutations and provided as examples, which are not intended to suggest limitations to the forms of the architecture. Other embodiments include a version where the entire hybrid game is in the cloud with only a client running on player terminal within the bounds of the casino, or a version where the RWE and GWE are casino bound and the ESE exists in the cloud, accessed by a client running on a terminal in the casino.

Processing Apparatuses

Figure 13:
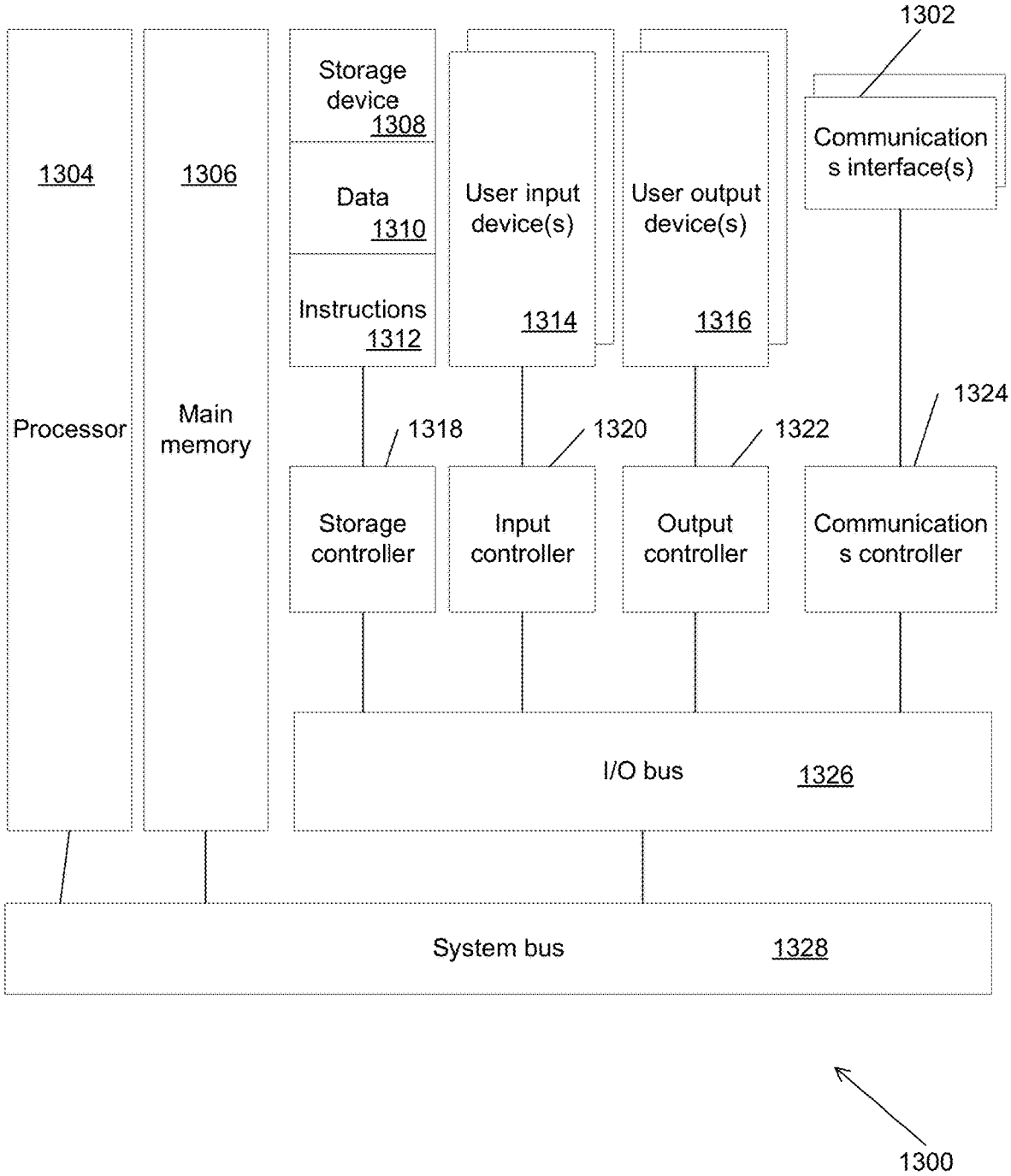
FIG. 13 illustrates a block diagram of components of a device implementing a gambling communicator hybrid game in accordance with an embodiment of this invention.

Any of a variety of processing apparatuses can host various components of a gambling communicator hybrid game in accordance with embodiments of the invention. In accordance with embodiments of this invention, these processing apparatuses can include, but are not limited to, mobile device such as a smartphone, personal digital assistant or the like, a wireless device such as a tablet computer or the like, an electronic gaming machine, a general purpose computer, a computing device and/or a controller. A processing apparatus that is constructed to implement a gambling communicator hybrid game in accordance with embodiments of the invention is illustrated in FIG. 13. In the processing apparatus 1300, a processor 1304 is coupled to a memory 1306 by a bus 1328. The processor 1304 is also coupled to non-transitory processor-readable storage media, such as a storage device 1308 that stores processor-executable instructions 1312 and data 1310 through the system bus 1328 to an I/O bus 1326 through a storage controller 1318. The processor 1304 is also coupled to one or more interfaces that can be used to connect the processor to other processing apparatuses as well as networks as described herein. The processor 1304 is also coupled via the bus to user input devices 1314, such as tactile devices including, but not limited to, keyboards, keypads, foot pads, touch screens, and/or trackballs; as well as non-contact devices such as audio input devices, motion sensors and motion capture devices that the processing apparatus can use to receive inputs from a user when the user interacts with the processing apparatus. The processor 1304 is connected to these user input devices 1314 through the system bus 1328, to the I/O bus 1326 and through the input controller 1320. The processor 1304 is also coupled via the bus to user output devices 1316 such as (but not limited to) visual output devices, audio output devices, and/or tactile output devices that the processing apparatus uses to generate outputs perceivable by the user when the user interacts with the processing apparatus. In accordance with some embodiments, the processor is coupled to visual output devices such as (but not limited to) display screens, light panels, and/or lighted displays. In accordance with particular embodiments, the processor is coupled to audio output devices such as (but not limited to) speakers, and/or sound amplifiers. In accordance with many of these embodiments, the processor 1304 is coupled to tactile output devices like vibrators, and/or manipulators. The processor 1304 is connected to output devices from the system bus 1328 to the I/O bus 1326 and through the output controller 1322. The processor 1304 can also be connected to a communications interface 1302 from the system bus 1328 to the I/O bus 1326 through a communications controller 1324.

In accordance with various embodiments, a processor 1304 can load instructions and data from the storage device into the memory 1306. The processor 1304 can also execute instructions that operate on the data to implement various aspects and features of the components of a gambling communicator hybrid game. The processor 1304 can utilize various input and output devices in accordance with the instructions and the data in order to create and operate user interfaces for players or operators of a gambling communicator hybrid game (such as but not limited to a casino that hosts the gambling communicator hybrid game).

Although the processing apparatus 1300 is described herein as being constructed from a processor and instructions stored and executed by hardware components, the processing apparatus can be composed of only hardware components in accordance with other embodiments. In addition, although the storage device is described as being coupled to the processor through a bus, those skilled in the art of processing apparatuses will understand that the storage device can include removable media such as, but not limited to, a USB memory device, an optical CD ROM, magnetic media such as tape and disks. Also, the storage device can be accessed by processor 1304 through one of the interfaces or over a network. Furthermore, any of the user input devices or user output devices can be coupled to the processor 1304 via one of the interfaces or over a network. In addition, although a single processor 1304 is described, those skilled in the art will understand that the processor 1304 can be a controller or other computing device or a separate computer as well as be composed of multiple processors or computing devices including one or more processors.

Gambling Game Communicator for a Gambling Communicator Hybrid Game

During gameplay of a gambling communicator hybrid game, a player is engaged in an entertainment game. At certain points in the game, gambling events may occur. The player may wager on the outcome of the gambling events. The wagering may be simultaneous with the game play of the entertainment game or the entertainment game may be paused to allow the gambling event to occur. A gambling communicator conveys information about the wagering occurrences and outcomes. In some embodiments, the various user interfaces of the gambling communicator may be selected through a Host Mode system and depending on the game in question, may be adjusted during game play. Each user interface may be individually adjustable by changing aspects of the gambling communicator including (but not limited to) the transparency, location, size and volume of the gambling communicator.

Figure 14:
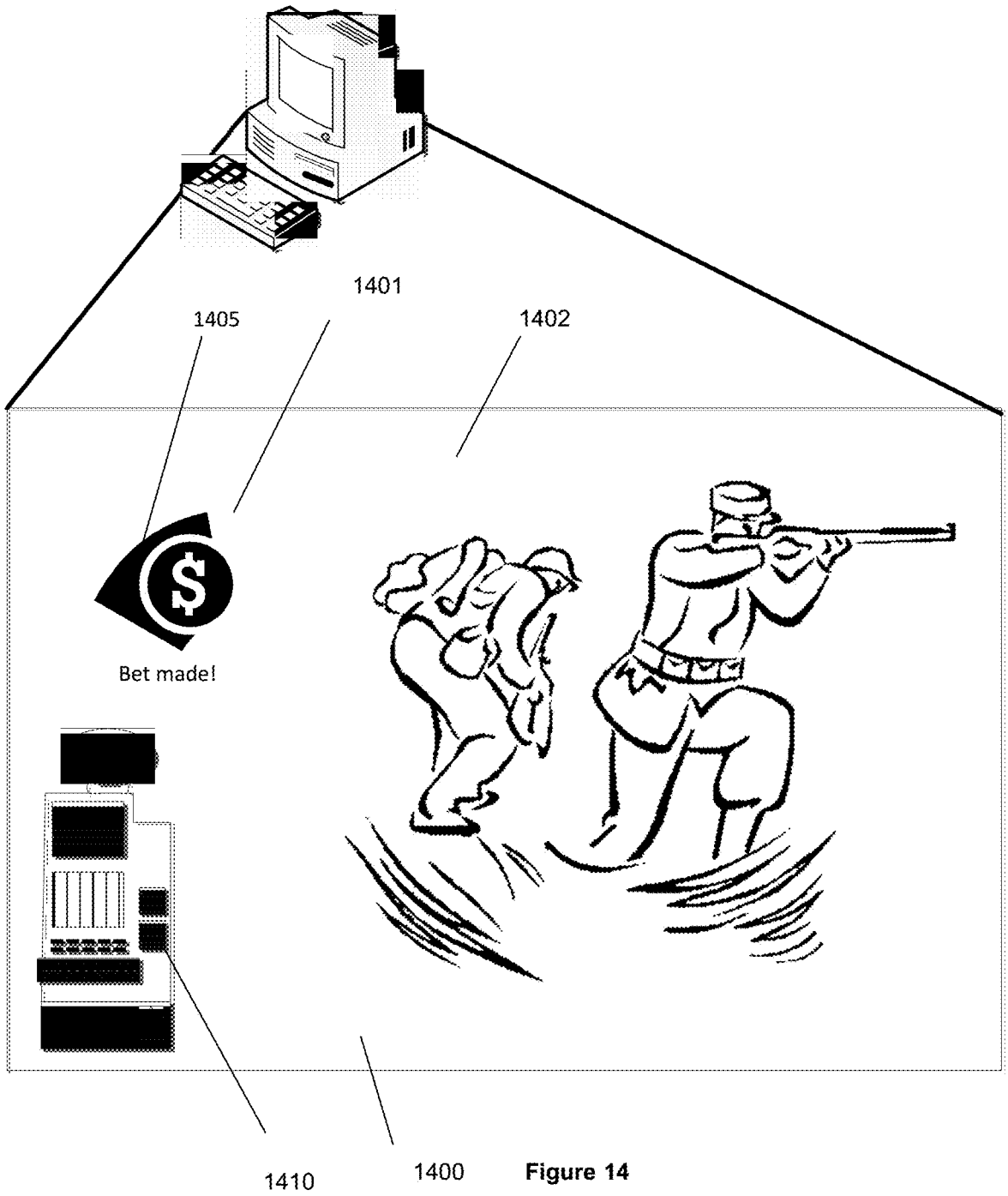
FIG. 14 conceptually illustrates a display generated by a gambling communicator hybrid game including a gambling communicator showing a slot machine in accordance with embodiments of this invention.
Figure 15:
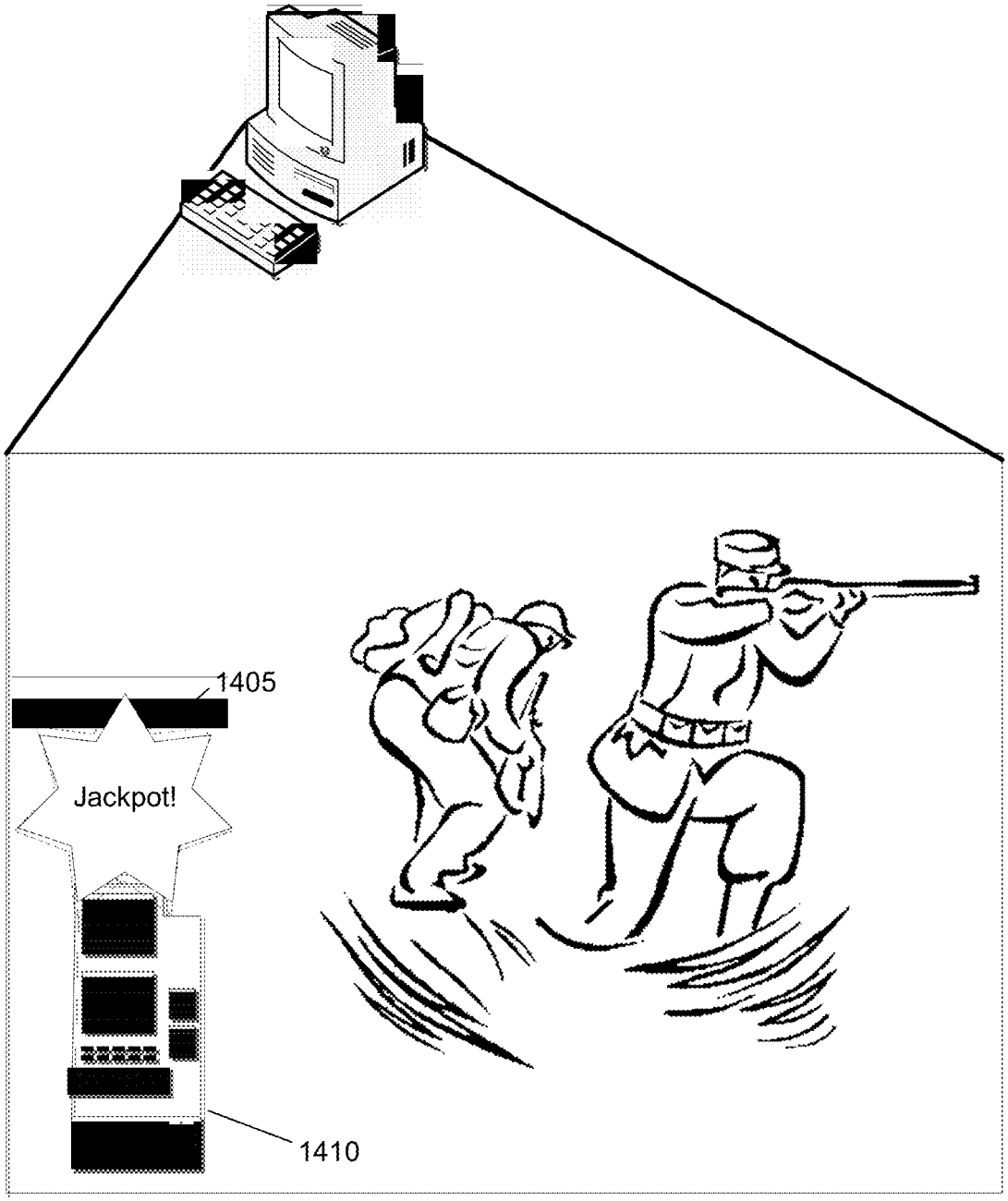
FIG. 15 conceptually illustrates a display generated by a gambling communicator hybrid game including a gambling communicator showing a slot machine when a player has won a wager in accordance with embodiments of this invention.
Figure 16:
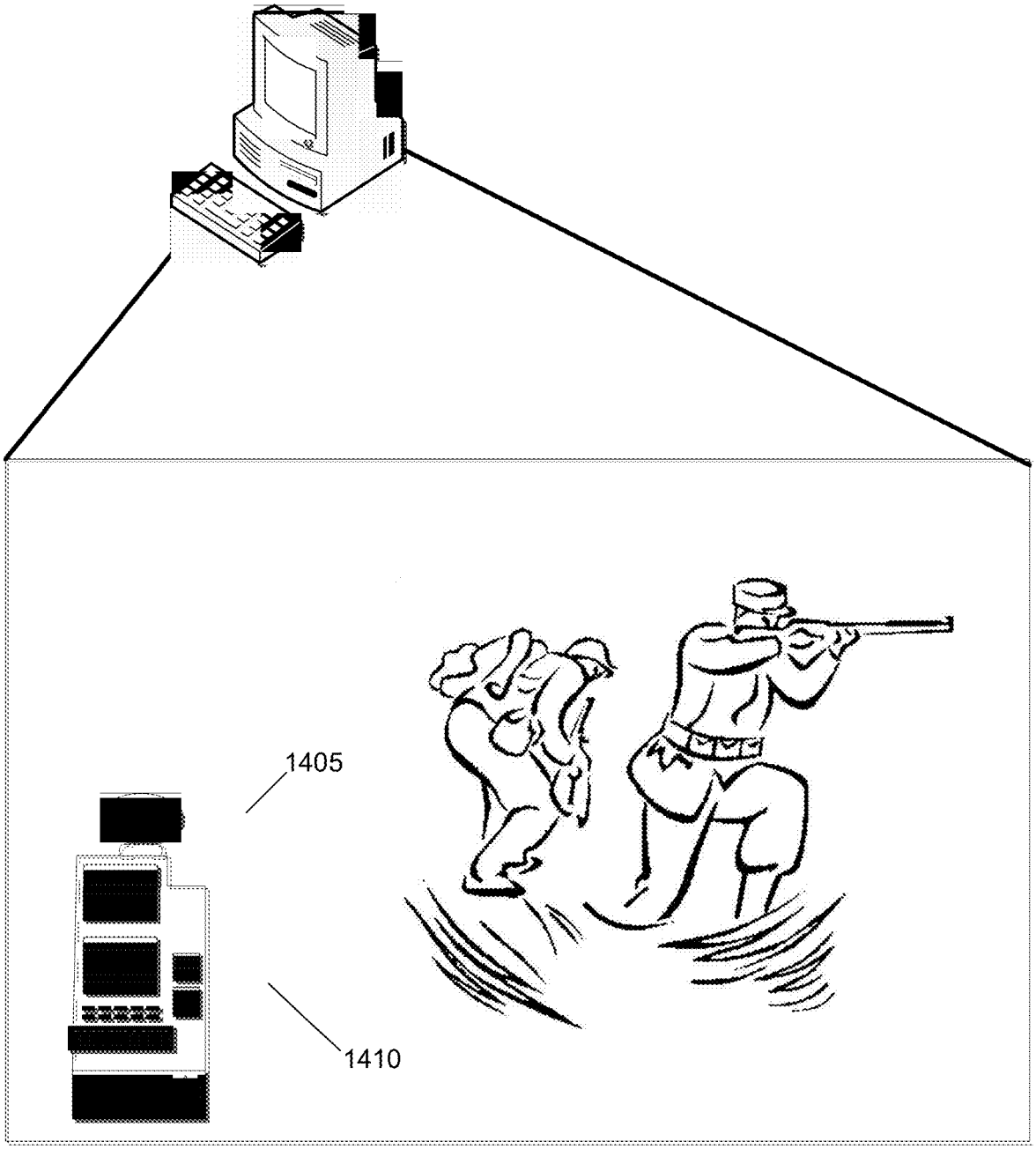
FIG. 16 conceptually illustrates a display generated by a gambling communicator hybrid game including a gambling communicator showing a slot machine when a player has lost a wager in accordance with embodiments of this invention.

Various embodiments of a user interface of a hybrid game system with a gambling communicator during a gambling event in accordance with embodiments of this invention are shown in FIGS. 14-16. In FIG. 14, the interface includes display 1400. The display 1400 is divided into an entertainment game portion 1402 and a gambling communicator portion 1401. Entertainment game portion 1401 is the portion of the display that provides the graphics of the entertainment game. One skilled in the art may recognize that the graphics of the entertainment game may be scaled from a full size to a reduced size in order to be displayed in the entertainment game portion 1402 that is a certain proportion of the full display size. The gambling communicator 1402 is the portion of the display 1400 that provides information about the gambling event. In accordance with the embodiments shown in FIGS. 14-16, the gambling communicator portion 1401 includes a gambling game presentation portion 1410 and a status icon 1405. In various embodiments, the gambling communicator portion 1402 may be constantly displayed or may only be displayed when a gambling event occurs. In the embodiments shown in FIGS. 14-16, gambling game presentation portion 1410 is a slot machine and the status icon 1405 changes as the gambling event occurs.

The following is an example of a gambling event occurring in the embodiments shown in FIGS. 14-16. As the player plays an entertainment game, a gambling event occurs. In the gambling communicator portion 1401, the status icon 1405 changes to a coin, the player may then wager on a gambling event by entering an amount of RC to wager. The gambling event then occurs and the results of the gambling event are shown by gambling game presentation portion 1410 as a rolling of reels in the slot machine and the resulting final position. In FIG. 15, the end of the spin results in the reels displaying alignment of three (3) 7s along a pay line. In response, the wager by the player is won and the status icon 1405 is changed to jackpot as shown in FIG. 15. When there is no alignment of a winning combination along a pay line in the slot machine shown in gambling game presentation portion 1410, the status icon 1405 displays a loss sign as shown in FIG. 16.

Figure 17:
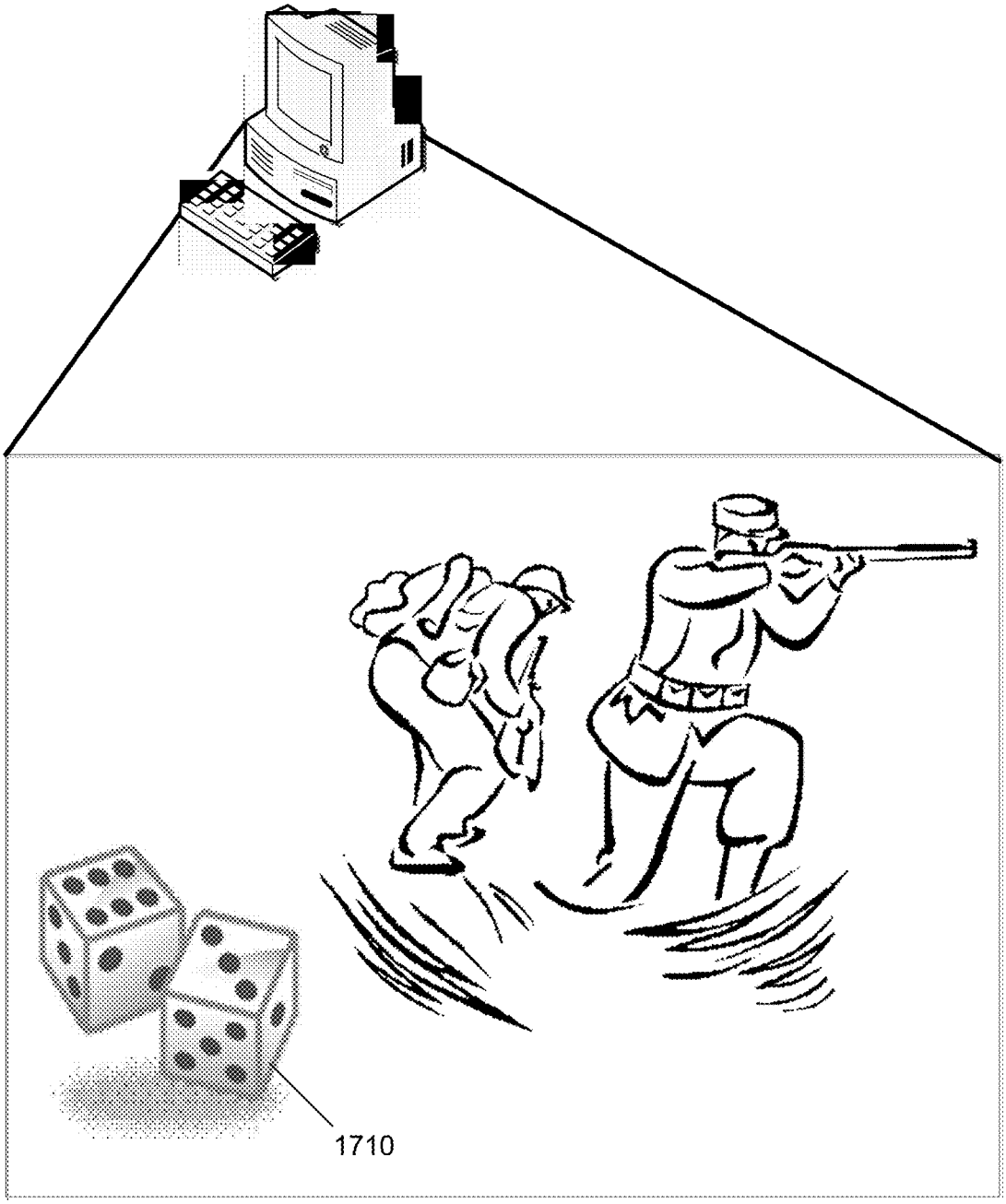
FIG. 17 conceptually illustrates a display generated by a gambling communicator hybrid game including a gambling communicator showing a roll of the dice representing a gambling event in accordance with embodiments of this invention.
Figure 18:
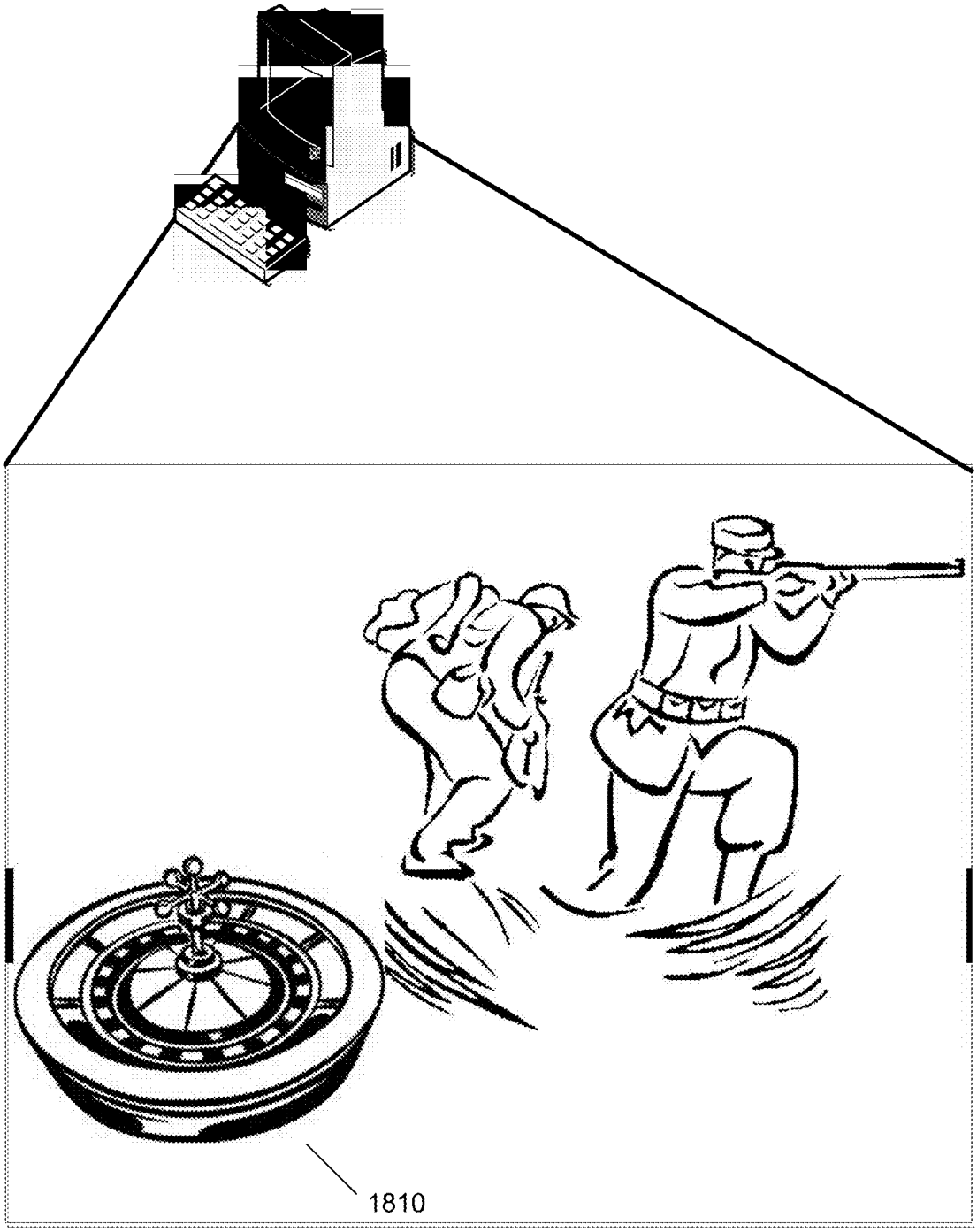
FIG. 18 conceptually illustrates a display generated by a gambling communicator hybrid game including a gambling communicator showing a roulette wheel representing a gambling event in accordance with embodiments of this invention.
Figure 19:
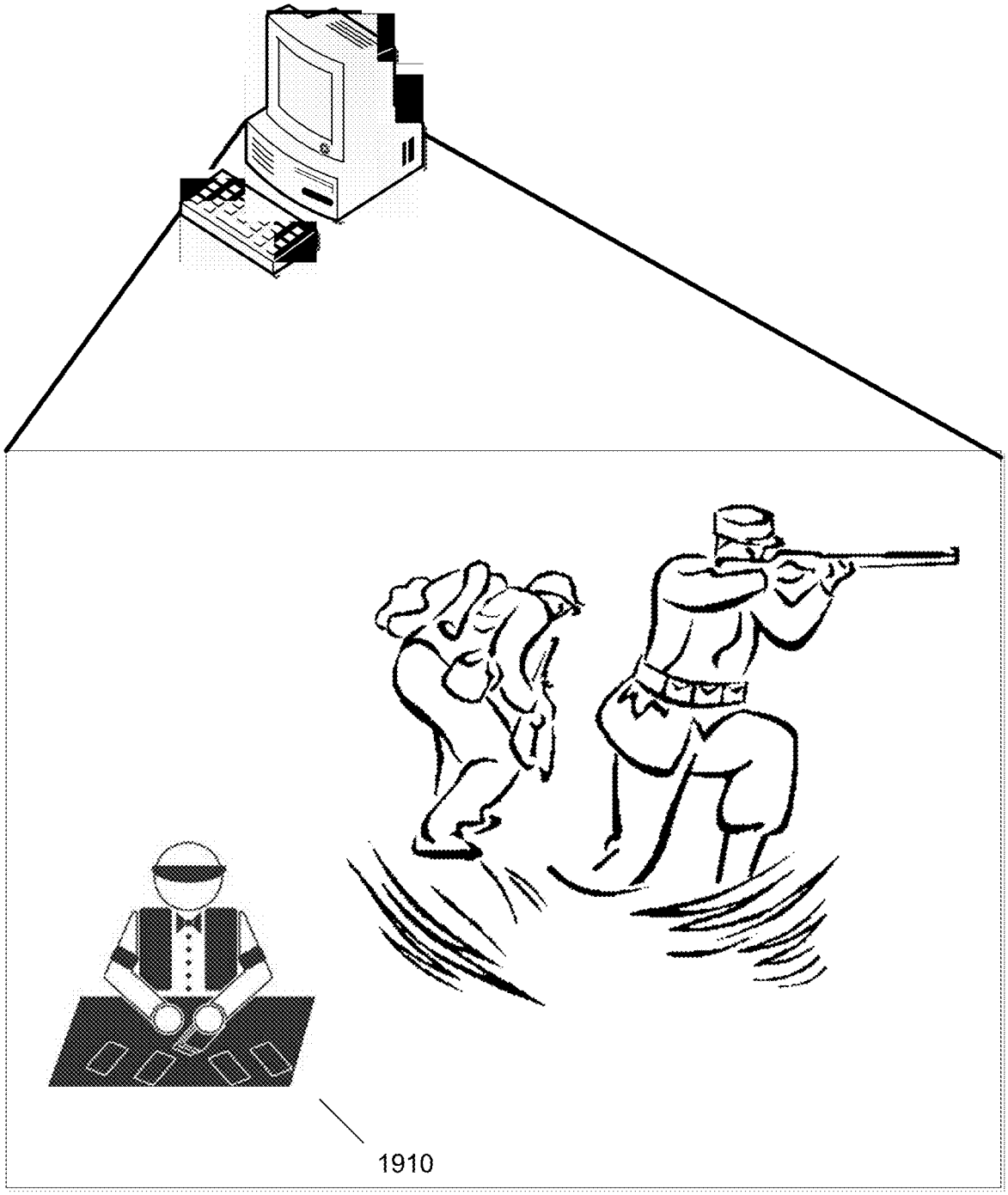
FIG. 19 conceptually illustrates a display generated by a gambling communicator hybrid game including a gambling communicator showing a dealer dealing a hand of cards representing a gambling event in accordance with embodiments of this invention.

Various representations of gambling games in the gambling game presentation portion 1410 of a display 1400 of a user interface in accordance with various embodiments of this invention are shown in FIGS. 17-19. In FIG. 17, the gambling game presentation portion 1710 is a graphical depiction of a dice roll. In FIG. 18, the gambling game presentation portion 1810 is a graphical depiction of a roulette wheel. In FIG. 19, the gambling game presentation portion 1910 is a graphical depiction of a dealer dealing a hand of cards.

Figure 20:
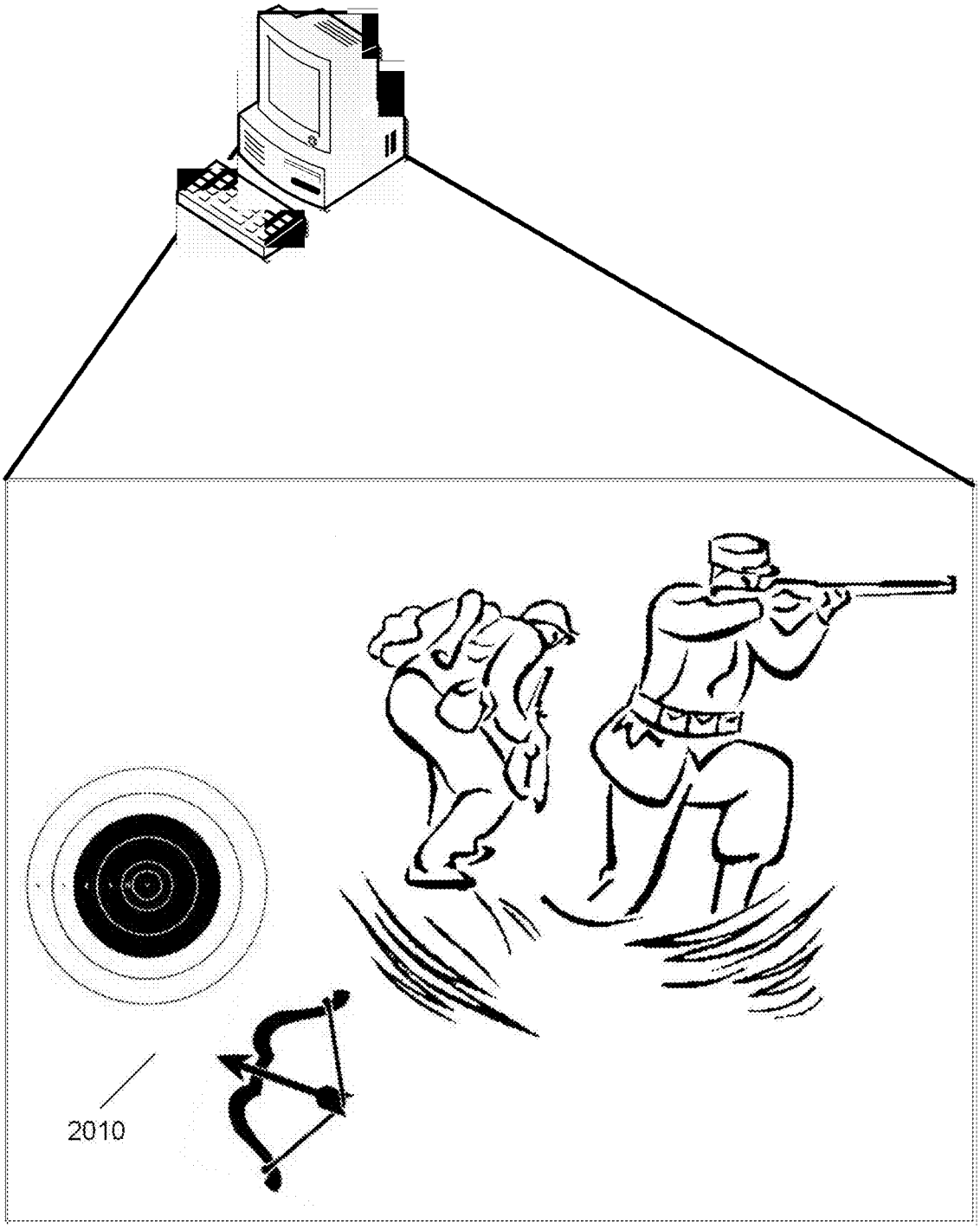
FIG. 20 conceptually illustrates a display generated by a gambling communicator hybrid game including a gambling communicator showing a projectile being aimed at a target representing a gambling event in accordance with embodiments of this invention.

A gambling game presentation portion for a gambling communicator hybrid game in accordance with embodiments of this invention in which a gambling event is a determination of whether a particular target is shown in FIG. 20. The gambling game presentation portion 2010 is a graphical depiction of an arrow flying towards a target. The arrow appears when a wager is initiated and lands in a particular portion of the target based on a RNG outcome. The position may indicate the amount of RC won on the wager placed on the gambling event. One skilled in the art will recognize that the same representation of a target may be used for other projectile weapons.

Figure 21:
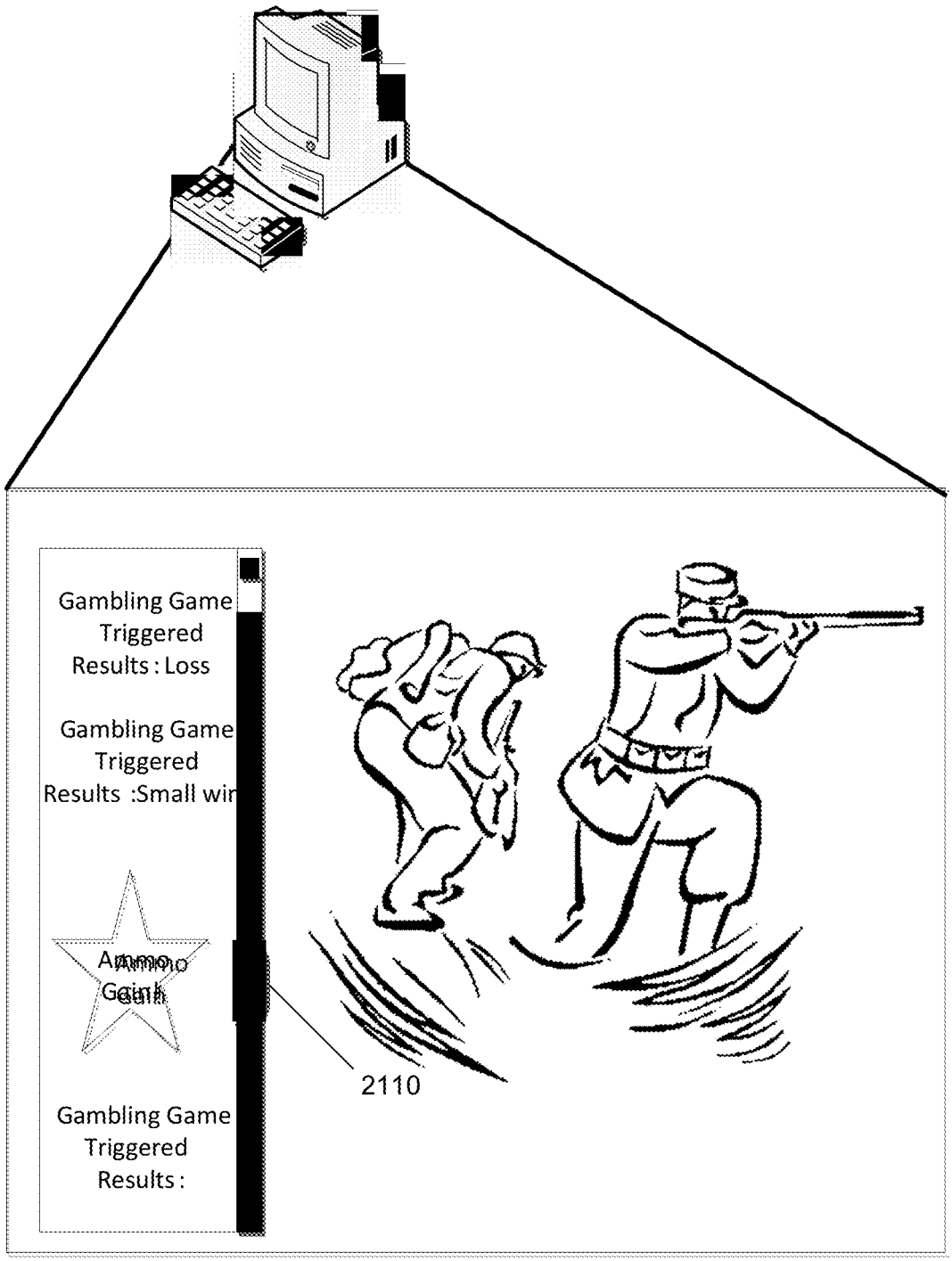
FIG. 21 conceptually illustrates a display generated by a gambling communicator hybrid game including a gambling communicator showing summary of the results of each gambling event in accordance with embodiments of this invention.

A gambling communicator that textually provides gambling event information in accordance with embodiments of this invention is shown in FIG. 21. In FIG. 21, the gambling game presentation portion 2110 is a textual depiction of the results of the gambling event. The textual depiction may be a transparent or a semi-transparent overlay on the graphics of the entertainment game. Furthermore, the textual depiction may display a player's history of wagering results, not merely the current gambling event information.

Figure 22:
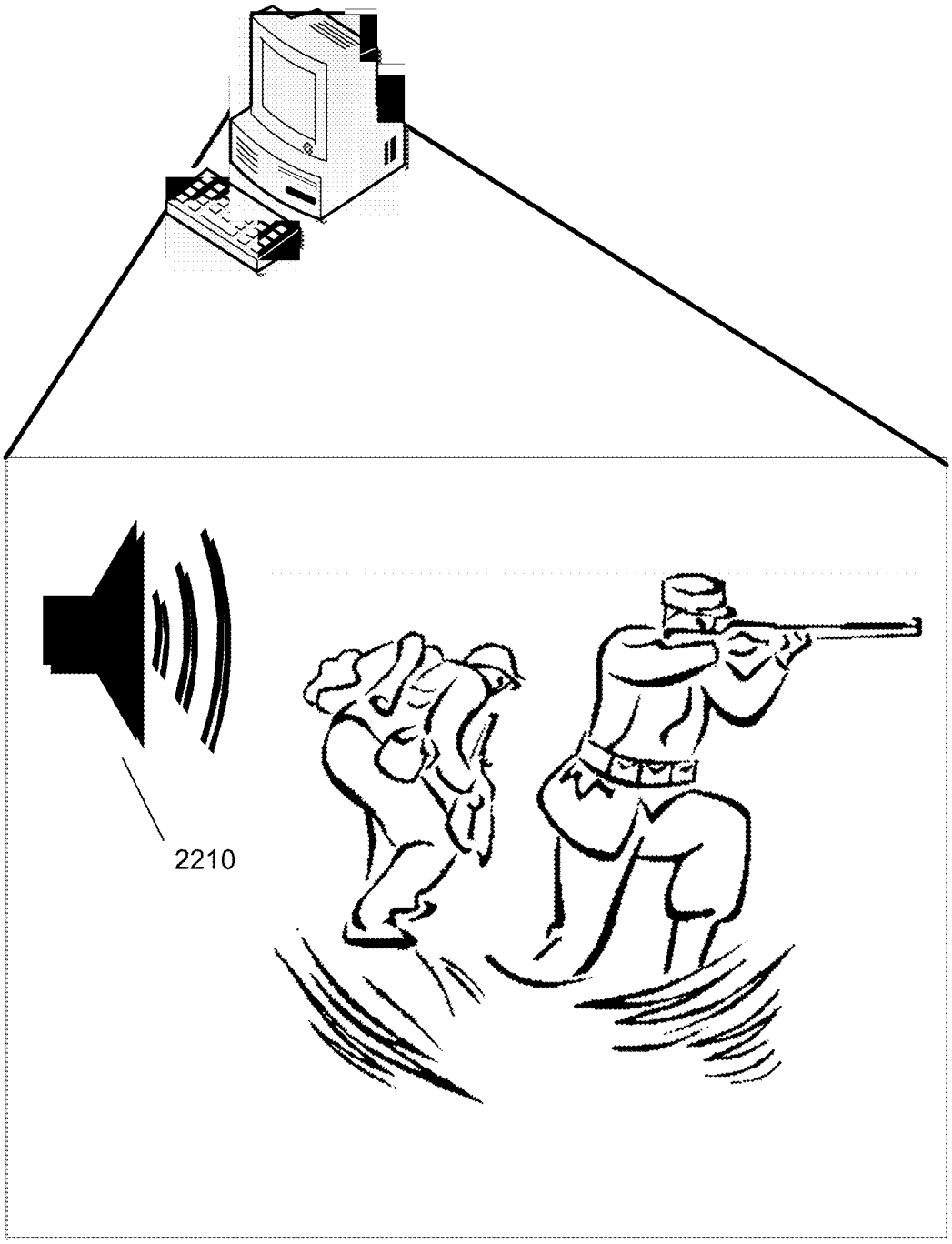
FIG. 22 conceptually illustrates a display generated by a gambling communicator hybrid game in which the gambling communicator is a sound in accordance with embodiments of this invention.

A gambling communicator that audibly provides gambling event information in accordance with embodiments of this invention is shown in FIG. 22. In FIG. 22, the gambling game presentation portion 2210 is an audible representation of the results of the gambling event. The audio representation of the gambling event results indicates wagering occurrences and wagering outcomes. The audio representation may be in a variety of languages and may include non-verbal audio content such as "cash register", "bonus", or "jackpot" sounds.

Figure 23:
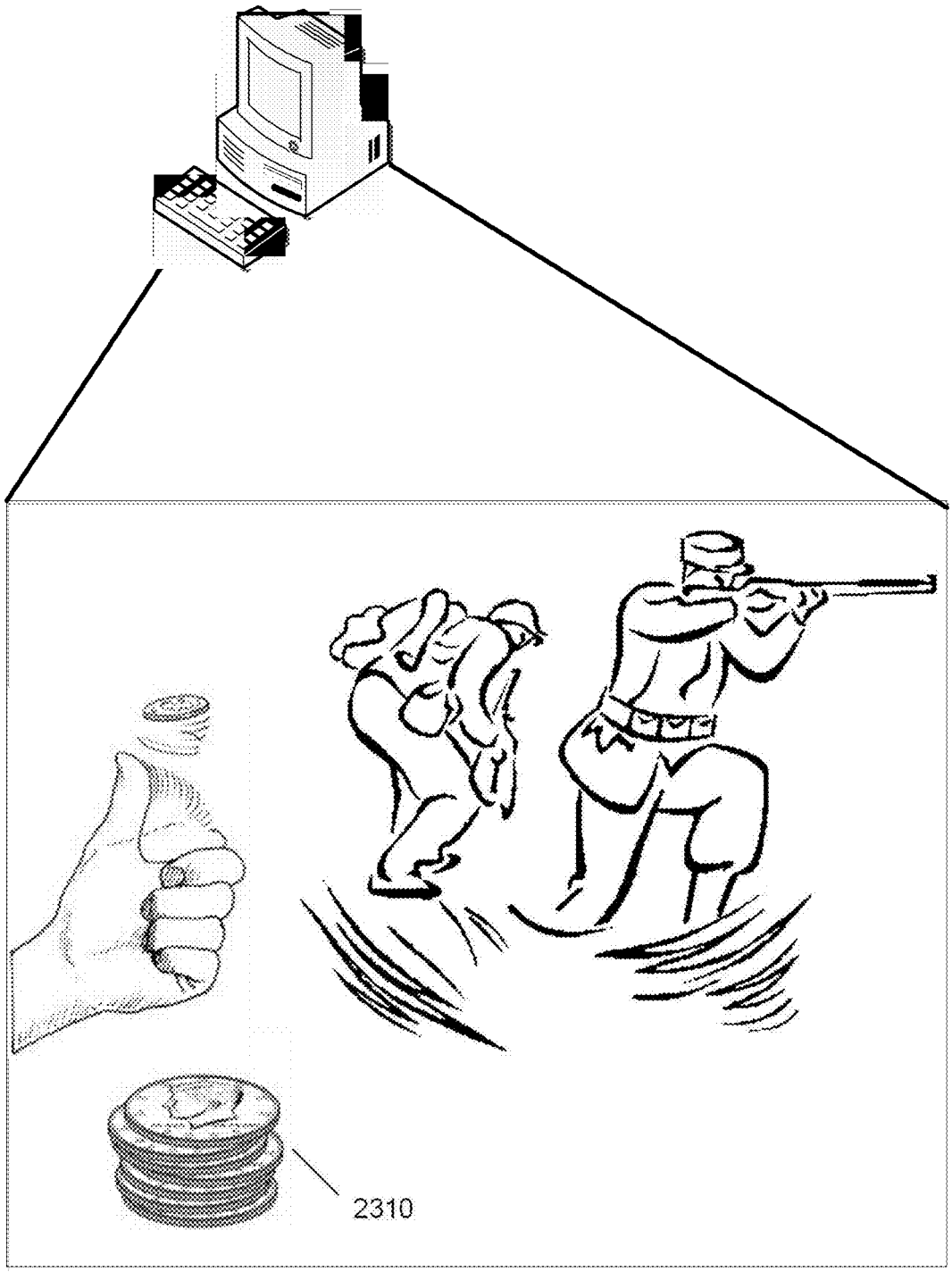
FIG. 23 conceptually illustrates a display generated by a gambling communicator hybrid game in which the gambling communicator includes a display of coins representing the amount won in a wager on a gambling event in accordance with embodiments of this invention.

A gambling communicator that provides gambling event information using graphical depiction of coin in accordance with embodiments of this invention is shown in FIG. 23. In FIG. 23, the gambling game presentation portion 2310 is conveyed through a graphical depiction coins flipping and growing in accordance to gambling wins or losses. When a gambling event is initiated, the coin is tossed. When a wager on the gambling event results in a gain of RC, the number of coins shown in the display increases. A loss of a wager on the gambling event results in fewer coins being displayed.

Although specific audio and graphical techniques for communicating information concerning gambling outcomes are described above with reference to FIGS. 14-23, any of a variety of audio and/or graphical indicators can be utilized to communicate the frequency and outcome of gambling events in the gambling game portion of a gambling communicator hybrid game in accordance with embodiments of the invention. Processes for communicating information concerning gambling events in accordance with embodiments of the invention are discussed further below.

Figure 24:
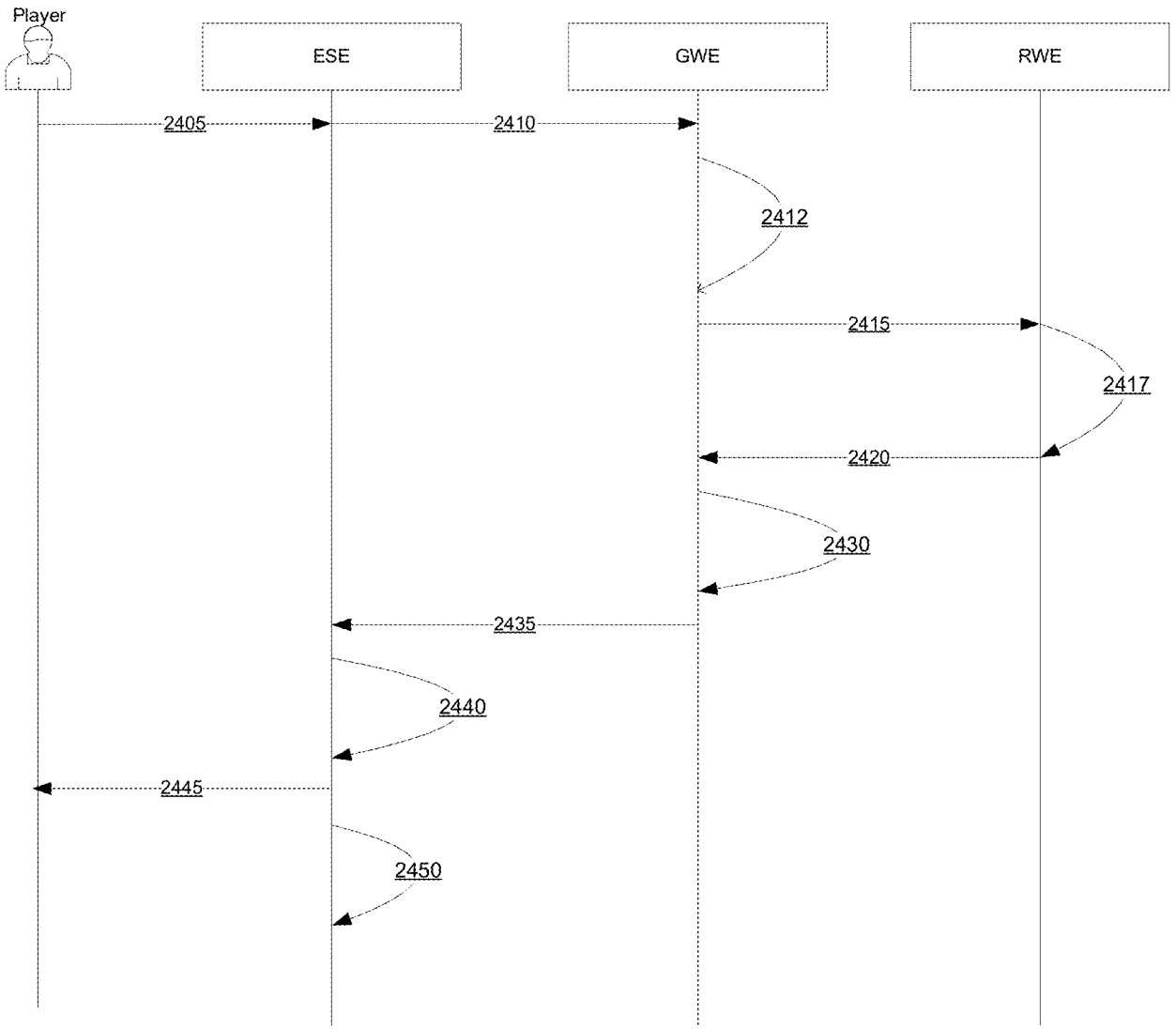
FIG. 24 illustrates a timing diagram of information passed between components of a gambling communicator hybrid game having that provides a gambling communicator in accordance with embodiments of this invention.

Processes for Providing a Gambling Communicator in a Gambling Communicator Hybrid Game A system that provides a gambling communicator hybrid game including gambling communicator, as described above, in accordance with embodiments of this invention is shown in FIGS. 24-27. A timing diagram of the information passed between various components of a gambling communicator hybrid game to provide gambling communicator is shown in FIG. 24. The process begins when the ESE interacts with the player while providing the entertainment game to the player (2405). Based upon progression of the entertainment game, the ESE generates and provides an update of entertainment game information to the GWE (2410). The GWE then determines (2412) that a gambling event is to occur based on the updated status of the entertainment game. To resolve the gambling event, the GWE provides a request (2415) for the gambling event to the RWE. The RWE then determines (2417) the result of the gambling event (2420). The result of the gambling event is then provided by the RWE to GWE. The GWE then generates (2430) gambling communicator information that provides information pertaining to the results of the gambling event and the change in any player accounts that occur based on the result of the gambling event and/or any wagers on the outcome of the gambling event (2420). The gambling communicator information is then provided by the GWE to the ESE (2435). The ESE updates (2440) the gambling communicator portion of the user interface according to the received gambling communicator information and presents (2445) the updated interface to the player while providing (2450) the entertainment game.

Figure 25:
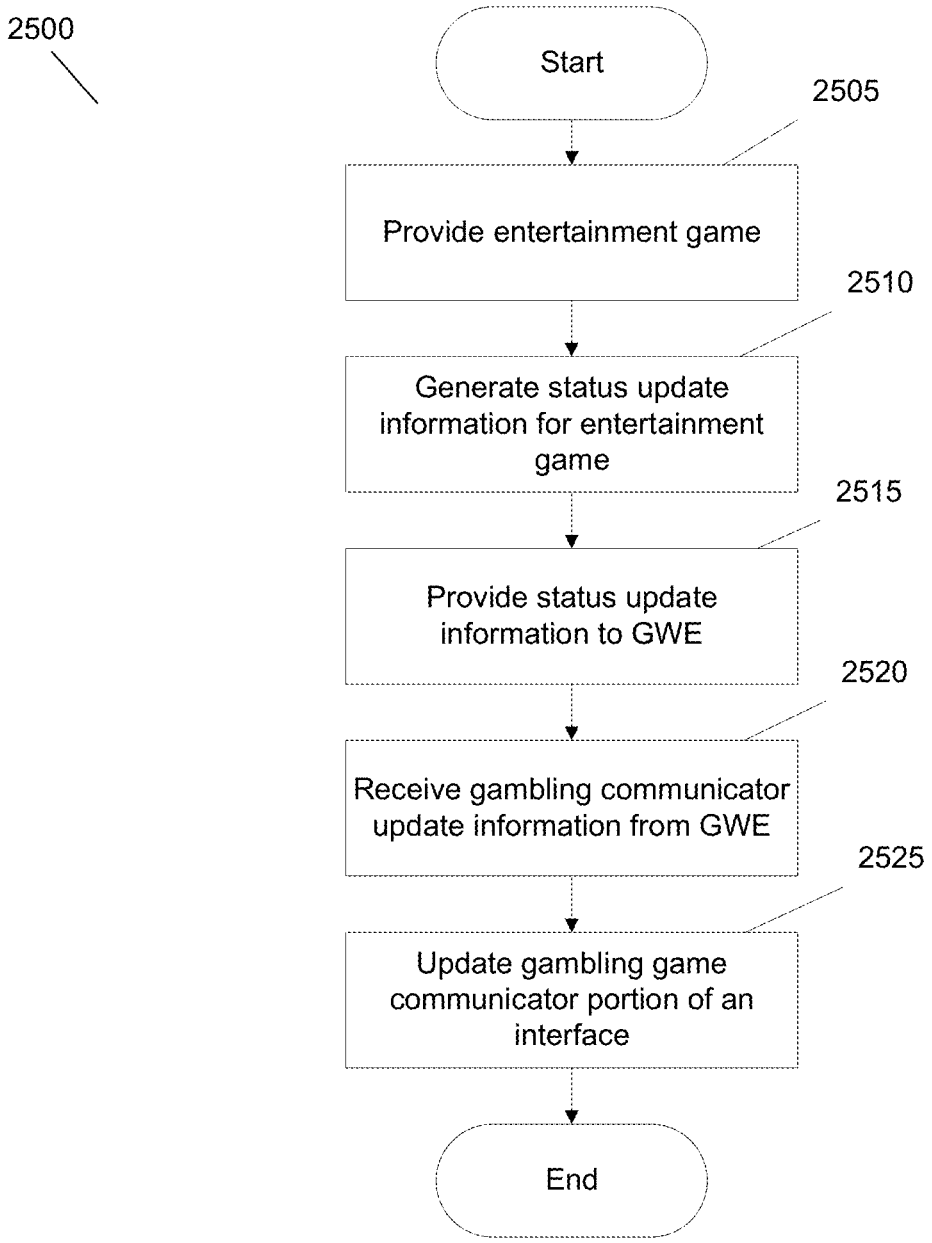
FIG. 25 illustrates a flow diagram of a process performed by an Entertainment System Engine to generate a gambling communicator hybrid game display including a gambling communicator in accordance with embodiments of this invention.

A process performed by an ESE for providing an entertainment game and updating the gambling communicator portion of a user interface based on the results of a gambling event in accordance with embodiments of this invention is shown in FIG. 25. In process 2500, the ESE provides the entertainment game to a player (2505). At a particular point in the entertainment game the ESE generates status update information (2510). The status update information is provided to the GWE by the ESE (2515). The ESE then receives gambling communicator information from the GWE (2520) and the ESE updates the gambling game communicator portion of an interface accordingly (2525).

Figure 26:
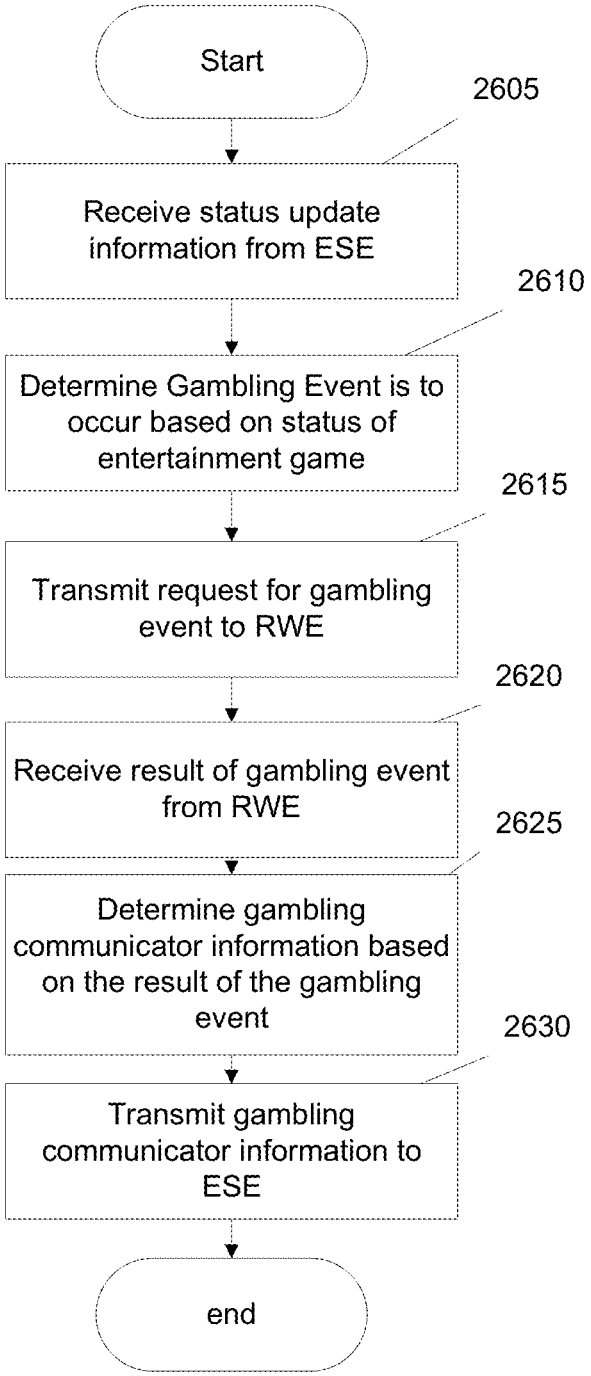
FIG. 26 illustrates a flow diagram of a process performed by a Game World Engine to generate a gambling communicator hybrid game display including a gambling communicator in accordance with embodiments of this invention.

A process for providing a gambling event and information for a gambling game communicator for a gambling communicator hybrid game performed by a GWE in accordance with embodiments of this invention is shown in FIG. 26. In process 2600, the GWE receives status update information from the ESE (2605). The GWE then determines a gambling event that is to occur based on the status of the entertainment game (2610). The determination may be made by any metric in the entertainment game that may indicate that a gambling event associated with game play is to occur. Furthermore, as described above, the determination may also use a past gambling event and/or RNG results to make the determination of the gambling event. GWE also may determine an amount to wager on a gambling proposition of the gambling event. The GWE then requests the determined gambling event be performed by the RWE (2615). The request may include the amount of RC to wager on the proposition. The GWE then receives the results of the gambling event from the RC (2620). The results provided to the GWE may also include RNG results and other information. The results of the gambling events are used by the GWE to determine gambling communicator information for use in providing the gambling game communicator based upon the result of the gambling event (2625). The gambling communicator information is transmitted by the GWE to the ESE (2630).

Figure 27:
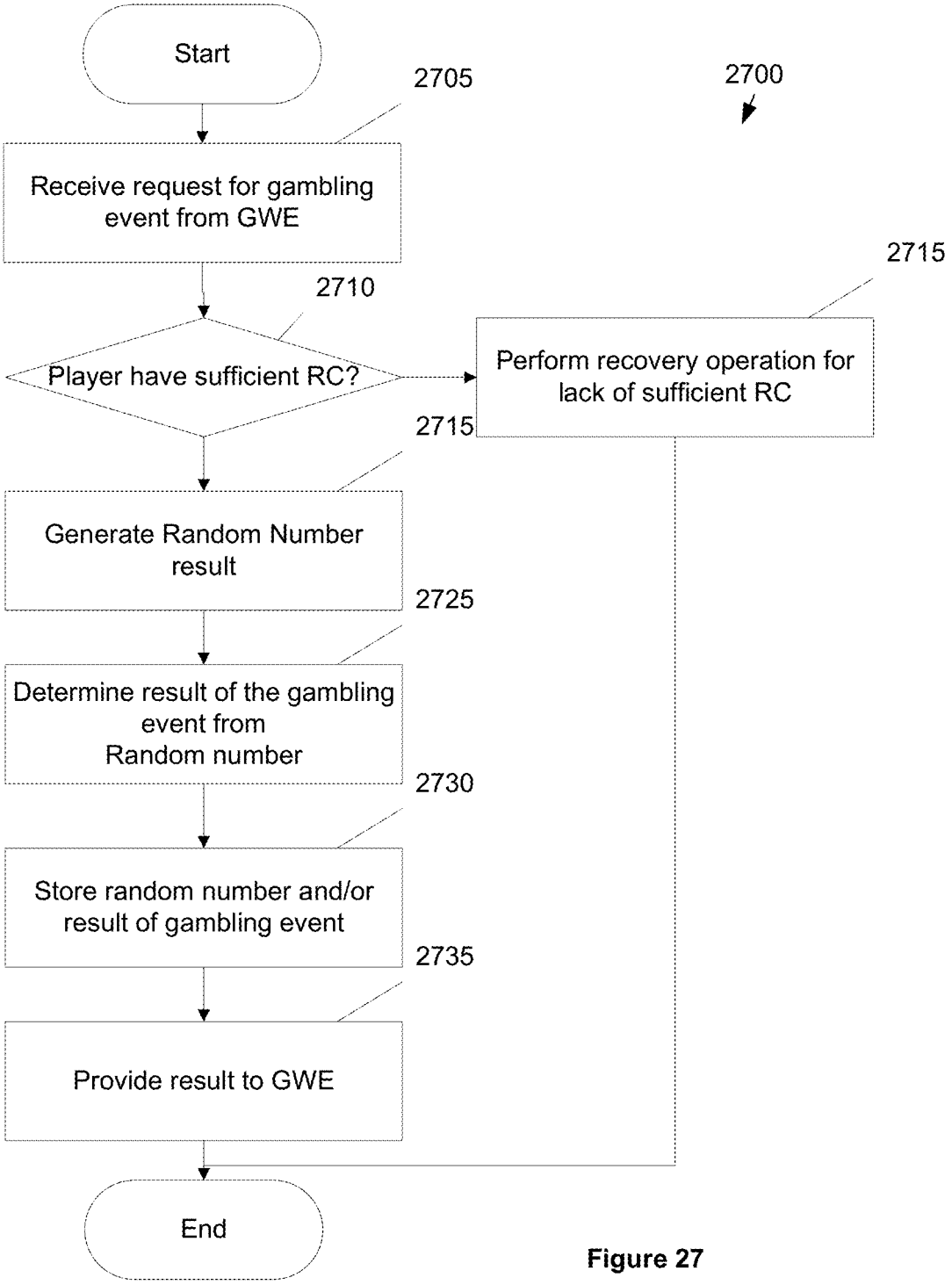
FIG. 27 illustrates a flow diagram of a process performed by Real World Engine to generate a gambling communicator hybrid game display including a gambling communicator in accordance with embodiments of this invention.

A process performed by the RWE to determine the results of the gambling events and provide the results to the GWE in accordance with embodiments of this invention is shown in FIG. 27. In process 2700, the RWE receives a request for a gambling event from the GWE (2705). The request may include amount wagered, an indication of a proper RNG to use, and an indication of the pay tables to use to resolve the wager. The RWE determines whether the player has sufficient RC available to cover the wager (2710). If the player does not have sufficient RC to cover the wager, the RWE performs a recovery operation (2715). The recovery operation may prevent the wager from occurring or may allow the player to supply the necessary funds to cover the wager. If the player has sufficient RC, the RWE generates a random number result using the proper RNG (2720). The random number result is then used to determine the results of the gambling event and do all other appropriate operations for updating the RC available to the player (2725). The RWE may store the result and/or other information about the result, including the random number result, in a database for future use (2730). The RWE also provides the result of the gambling event to the GWE (2735).

Although certain specific features and aspects of a gaming system have been described herein, many additional modifications and variations would be apparent to those skilled in the art. For example, the features and aspects described herein may be implemented independently, cooperatively or alternatively without deviating from the spirit of the disclosure. It is therefore to be understood that gaming system may be practiced otherwise than as specifically described. Thus, the foregoing description of the gaming system should be considered in all respects as illustrative and not restrictive, the scope of the claims to be determined as supported by this disclosure and the claims' equivalents, rather than the foregoing description.

What is claimed is:

1. A distributed gaming system for a hybrid game having a gambling game and an interactive entertainment game, comprising:

an entertainment system engine on a mobile computing device including a user input device and a display output device, wherein the entertainment system engine is connected to a game world engine server via a network, and wherein the entertainment system engine is constructed to:

provide a user interface for a player of the hybrid game, wherein the user interface includes an entertainment game portion and a gambling game communicator portion;

distribute to the game world engine server, an action taken by the player while playing the entertainment game and interacting with the entertainment game portion of the user interface;

receive from the game world engine server, gambling game communicator information that a wager of real world credits has been triggered;

generate a perceivable signal that the wager of real world credits has been triggered;

receive from the game world engine server, gambling game communicator information including a wager outcome and an adjustment to the entertainment game;

generate a display for the wager outcome using the gambling game communicator portion of the user interface; and generate a display for the adjustment to the entertainment game portion of the user interface;

a real world engine server having a random number generator and connected to the game world engine via a communication link, wherein the real world engine server is constructed to:

receive from the game world engine via the communication link, a trigger of a gambling event of the wager of real world credits;

determine an amount of real world credits for the wager associated with the player;

execute the wager of real world credits in accordance with a regulated gambling proposition of the gambling game to determine a result of the gambling event using the random number generator; and distribute to the game world engine via the communication link, the result of the gambling event; and the game world engine connected to the entertainment system engine and connected to the server by the communication link, wherein the game world engine is configured to:

receive from the entertainment system engine, the player action;

determine the trigger of the gambling event using the player action;

distribute to the server via the communication link, the trigger of the gambling event;

generate the gambling game communicator information based upon the gambling event;

receive from the server via the communication link, the result of the gambling event;

calculate the adjustment to the entertainment game based upon the result of the gambling event;

generate the gambling game communicator information based upon the result of the gambling event and the adjustment to the entertainment game; and distribute to the entertainment system engine, the gambling game communicator information.

2. The distributed gaming system for a hybrid game having a gambling game and an interactive entertainment game of claim 1 wherein the gambling game communicator portion includes a gambling game presentation portion and a status portion.

3. The distributed gaming system for a hybrid game having a gambling game and an interactive entertainment game of claim 2 wherein the gambling game presentation portion includes a graphical depiction of a gambling game.

4. The distributed gaming system for a hybrid game having a gambling game and an interactive entertainment game of claim 2 wherein the gambling game presentation portion includes a textual description of the gambling event.

5. The distributed gaming system for a hybrid game having a gambling game and an interactive entertainment game of claim 2 wherein the gambling game presentation portion includes an audio presentation related to the gambling event.

6. The distributed gaming system for a hybrid game having a gambling game and an interactive entertainment game of claim 2 wherein the status portion includes a graphic depiction indicating the result of a wager on the gambling event.

7. The distributed gaming system for a hybrid game having a gambling game and an interactive entertainment game of claim 1 wherein the game world engine server and the real world engine server are constructed from a single processing apparatus.

8. The distributed gaming system for a hybrid game having a gambling game and an interactive entertainment game of claim 1 wherein the game world engine server and the real world engine server are constructed from different processing apparatuses, and wherein the communication link utilizes the network.

9. The distributed gaming system for a hybrid game having a gambling game and an interactive entertainment game claim 1 wherein the real world engine server performs a recovery operation if there are insufficient real world credits for the wager.

* * * * *